US010589160B2

(12) United States Patent
Hunt

(10) Patent No.: US 10,589,160 B2
(45) Date of Patent: Mar. 17, 2020

(54) GOLF SWING IMPROVEMENT TOOL

(71) Applicant: WiSys Technology Foundation, Inc., Madison, WI (US)

(72) Inventor: Samuel B. Hunt, De Pere, WI (US)

( * ) Notice: Subject to any disclaimer, the term of this patent is extended or adjusted under 35 U.S.C. 154(b) by 0 days.

(21) Appl. No.: 16/037,505

(22) Filed: Jul. 17, 2018

(65) Prior Publication Data

US 2019/0022504 A1 Jan. 24, 2019

Related U.S. Application Data

(60) Provisional application No. 62/533,812, filed on Jul. 18, 2017.

(51) Int. Cl.

| | |
|---|---|
| ***A63B 69/36*** | (2006.01) |
| ***A63B 1/00*** | (2006.01) |
| *A63B 102/32* | (2015.01) |

(52) U.S. Cl.

CPC ..... *A63B 69/3632* (2013.01); *A63B 1/00* (2013.01); *A63B 2102/32* (2015.10); *A63B 2225/09* (2013.01)

(58) Field of Classification Search

CPC ..... A63B 69/3632; A63B 2102/32; A63B 2225/09; A63B 1/00; A63B 102/32

See application file for complete search history.

(56) References Cited

U.S. PATENT DOCUMENTS

| | | | | |
|---|---|---|---|---|
| 5,009,426 | A | 4/1991 | Cox | |
| 5,156,401 | A * | 10/1992 | Hodgkiss | A63B 69/3632 473/227 |
| 5,851,156 | A | 12/1998 | Orville, Jr. | |
| 7,455,595 | B1 * | 11/2008 | Gibbons | A63B 69/3608 473/212 |
| 8,128,507 | B1 * | 3/2012 | Chuck | A63B 69/3632 473/227 |
| 10,071,300 | B2 * | 9/2018 | Herberth | A63B 69/0059 |

FOREIGN PATENT DOCUMENTS

JP 2006255304 A 9/2006

OTHER PUBLICATIONS http://www.b1bluestrikegolf.com (screenshot dated Aug. 21, 2018).
https://www.hangergolf.com/ (screenshot dated Aug. 21, 2018).

* cited by examiner

*Primary Examiner* — Stephen L Blau
(74) *Attorney, Agent, or Firm* — Boyle Fredrickson S.C.

(57) ABSTRACT

A golf swing improvement tool is provide that attaches to a golf club, and includes a guide arm contacting the leading forearm of a golfer. An offset arm allows the guide arm to be offset laterally from the longitudinal axis of the golf club. The user adjusts the offset distance to give a specific leading arm-to-club relationship. If the club moves ahead of the desired relationship with the leading arm during the swing, the user will be alerted to this error by the guide arm loosing contact with the forearm.

14 Claims, 18 Drawing Sheets

GOLF SWING IMPROVEMENT TOOL

CROSS REFERENCE TO RELATED APPLICATION

This application claims the benefit of U.S. provisional application 62/533,812, filed Jul. 18, 2017, and hereby incorporated by reference.

BACKGROUND OF THE INVENTION

Golf is a popular sporting activity played by millions of people worldwide. Especially popular are training tools designed to improve a player's technical skill. One important skill is the ability to control the relationship between the golf club and the leading arm during a swing.

Variations in the leading arm-to-club relationship at impact result in different golf ball velocities and trajectories. This is due to the centripetal force urging the club to seek an in-line relationship with the leading arm. As the moment of impact approaches, if the club head is lagging behind the leading arm, the club head will experience an accelerating force urging it to catch up and become in-line with the leading arm. This force counters the deceleration force of the golf ball at impact and, as a result, power and control are highest. The opposite is true if the club head moves ahead of the leading arm prior to impact. In this case, centripetal force urges the leading club head to slow down and power loss occurs.

Thus, there exists an ongoing need for a training tool that provides feedback about the relationship between the leading arm and the golf club during a swing. More precisely, the tool should enable the user to experiment with a continuous range of variations in this relationship so as to observe the differences in the resulting ball behaviors. Advantageously, the tool is adjustable, making it equally effective for golfers of varying grip styles and arm thicknesses.

U.S. Pat. No. 8,128,507 to Chuck discloses an arching guide arm that rests against the golfer's forearm. With Chuck's device, the user is unable to select the exact relationship between the club and the leading arm. The user can only choose from two possible relationships between the leading arm and the club—one with the club lagging, and one with the club in front of the leading arm. Because Chuck's guide arm is only adjustable vertically, using a lagging club head requires the guide arm to separate from the forearm during the backswing, pass under the arm and become in front of the arm at impact. For each of these two options, the exact relationship of the club is at the mercy of the forearm girth and grip style of the individual user.

U.S. Pat. No. 5,009,426 to Cox discloses a guide that rests against the user's trailing arm. Cox's device provides feedback about the trailing arm in relation to the club. However, because the relationship between the leading and trailing arms can vary, controlling the trailing arm-to-club relationship does not necessarily result in controlling the leading arm-to-club relationship.

SUMMARY OF THE INVENTION

In accordance with one embodiment of the present invention, a golf swing improvement tool comprises a coupling base member that attaches to a golf club, a guide arm to contact the leading forearm of a golfer, and an offset arm that allows the guide arm to be offset laterally from the longitudinal axis of the golf club and club head face. The user adjusts the offset distance to give a specific leading arm-to-club relationship. If the club moves ahead of the desired relationship with the leading arm during the swing, the user will be alerted to this error by the guide arm losing contact with the forearm.

The present invention provides a golf swing improvement tool having a coupling attachable to a golf club having a golf club head with a transversely extending club head face attached to a distal end of a golf club shaft leading to a golf club handle at a proximal end of the golf club shaft, the golf club shaft having a shaft axis; an offset segment supported by the coupling and extending away from the shaft axis; and a guide arm attached to the offset segment so that the guide arm may be in a direction closer to the club head from a point offset from the shaft axis.

It is thus a feature of at least one embodiment of the invention to provide a golf swing improvement tool that provides feedback about the leading arm-to-club relationship, to allow a golfer to select the precise relationship from a continuous range of possibilities, to remain in contact with the user's leading forearm throughout the swing for all these relationships, and to accommodate the individual grip style and forearm girth of each user.

The coupling may extend from a proximal end of the golf club handle.

It is thus a feature of at least one embodiment of the invention to install the coupling so that it does not interfere with the user's natural golf swing.

The offset segment may provide an adjustable offset away from a plane defined by the club shaft axis and a leading edge of the club face.

It is thus a feature of at least one embodiment of the invention to adjust the offset to different user grips and different forearm widths.

The offset may connect to the guide arm with at least one pivot having an axis parallel to the plane defined by the club shaft axis and the club face.

It is thus a feature of at least one embodiment of the invention to adjust the offset laterally, to the left or right of the golf shaft axis.

The offset segment may provide an adjustable offset by a first pivot pivoting about a first axis substantially parallel to the plane defined by the club shaft axis and the club face and a second pivot pivoting about a second axis substantially parallel to the plane defined by the club shaft axis and the club face, the first pivot connected to the coupling and the second pivot connected to the guide arm.

It is thus a feature of at least one embodiment of the invention to provide simple adjustment without protruding ends that would occur with a sliding adjustment.

The offset segment may further comprise a third pivot pivoting about a third axis substantially perpendicular to the first and second axes.

It is thus a feature of at least one embodiment of the invention to allow the guide arm to be angled with respect to the plane defined by the club shaft axis and the club face for additional flexibility.

A guide arm plane and the plane may be defined by the club shaft axis and the club face may be adjustable to be in parallel offset planes.

It is thus a feature of at least one embodiment of the invention to create a parallel alignment with an axis of the shaft.

The guide arm may curve within a guide arm plane.

It is thus a feature of at least one embodiment of the invention to allow the guide arm to contact the user's arm throughout the swing.

The coupling may be adapted to be inserted within the gold club handle and extend from a proximal end of the golf club handle. The coupling may comprise of angled segments adapted to contact opposed sidewalls of the golf club handle.

It is thus a feature of at least one embodiment of the invention to allow the training device to be installed along an axis of the shaft without interfering with the user's grip.

The coupling may be adapted to clasp around the golf club handle.

It is thus a feature of at least one embodiment of the invention to allow the training device to be used with older golf clubs that do not have a vent hole.

The offset segment may provide an adjustable offset by a slide bar slideable along an axis perpendicular to the shaft axis.

It is thus a feature of at least one embodiment of the invention to maintain the plane of the guide arm parallel to the plane of the shaft and striking face.

The guide arm may include a stop bar extending perpendicular to a guide arm plane and supported at a distal end of the guide arm.

It is thus a feature of at least one embodiment of the invention to determine the maximum angle of wrist cock.

The guide arm may be attached to the golf club handle at a distal end from the attachment of the coupling to the golf club handle.

It is thus a feature of at least one embodiment of the invention to provide additional stability to the device.

The guide arm may extend above the golf club shaft toward a top edge of the club head face. The guide arm may extend below the golf club shaft toward a bottom edge of the club head face.

It is thus a feature of at least one embodiment of the invention to keep the device out of the user's field of vision during a swing.

These and other advantages will become apparent from a consideration of the accompanying drawings and ensuing description.

These particular objects and advantages may apply to only some embodiments falling within the claims and thus do not define the scope of the invention.

DETAILED DESCRIPTION OF THE PREFERRED EMBODIMENTS

First Embodiment—FIGS. 1-10

Figure 1A:
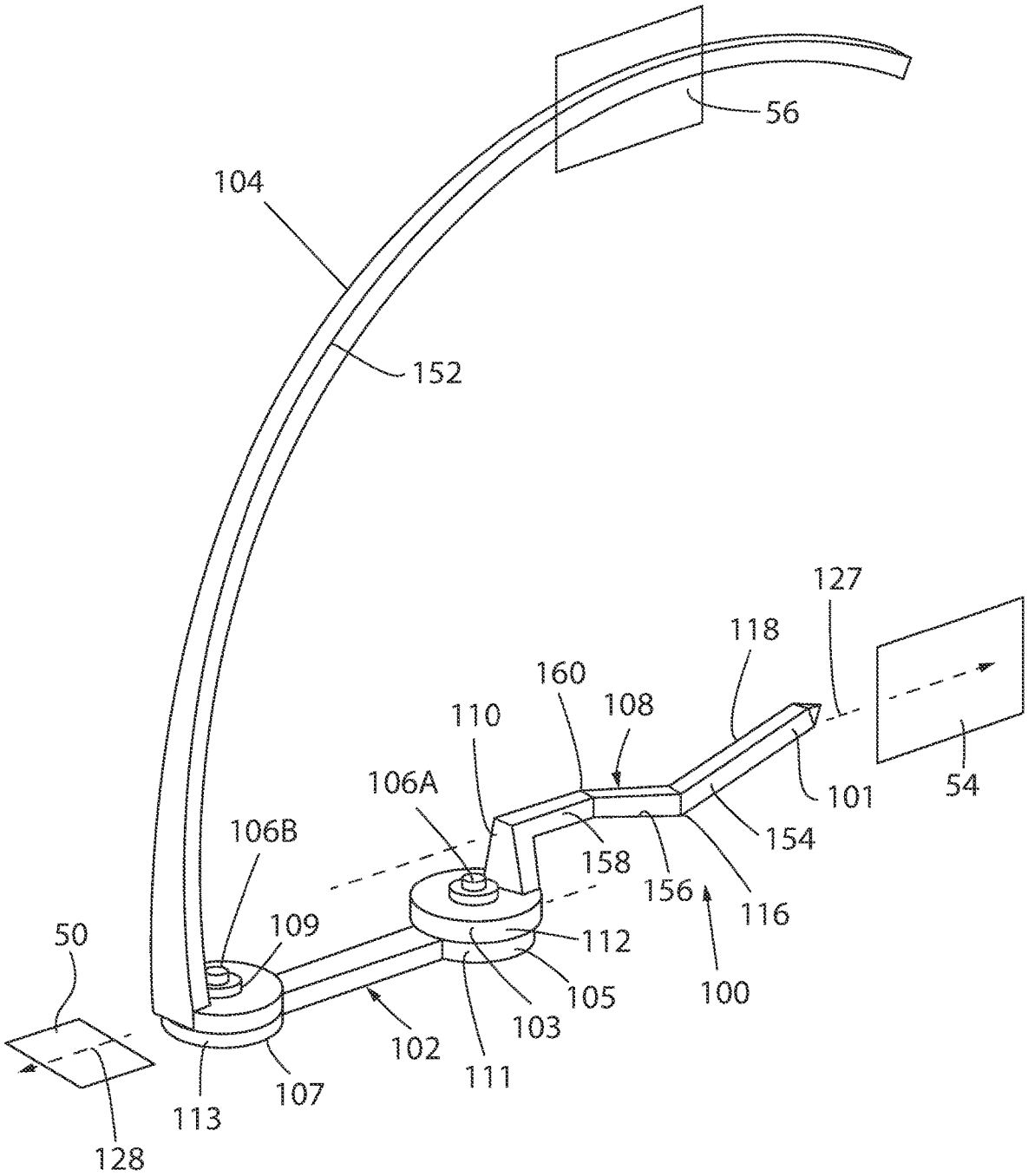
FIG. 1*a* is a perspective view of a first embodiment of the present invention providing a golf swing improvement tool attachable to a golf club.

Referring to FIG. 1*a*, a perspective view of one embodiment of the golf swing improvement tool is shown. Included in this embodiment is a coupling base member 100 connectable to a golf club 115 having a distal end 101 opposite a proximal end 103, and further connected to an offset arm 102 having a first end 105 connected to the base member 100 and a second end 107 connected to a guide arm 104, the guide arm 104 contacting the user's arm. The offset arm 102 is pivotally connected to the base member 100 at a first positioning hinge 106A to allow the offset arm 102 to rotate about a plane 50, and the guide arm 104 is pivotally connected to the offset arm 102 at a second positioning hinge 106B to allow the guide arm 104 to extend and curve along a plane 56, perpendicular to the plane 50 of rotation of the offset arm 102.

Figure 1B:
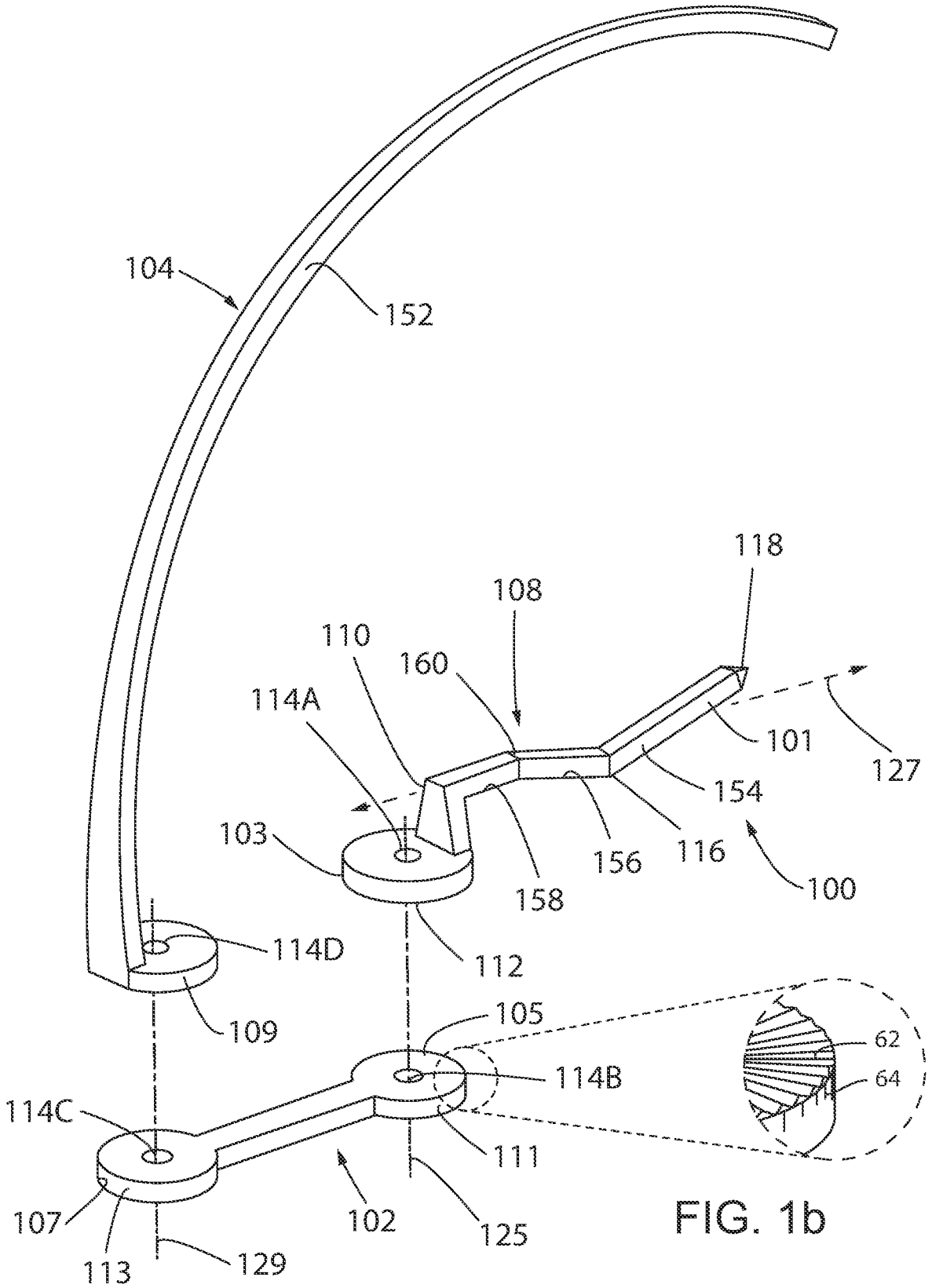
FIG. 1*b* is an exploded perspective view of the first embodiment shown in FIG. 1*a;*

Referring also to FIG. 1*b*, an exploded view of the first embodiment of FIG. 1*a* is shown. The base member 100 comprises, more specifically, of a prong 108 penetrating an end of a golf club 115 and defining the distal end 101 of the base member 100. The prong 108 may include a distal end segment 154 attached to a center segment 156 connecting the distal end segment 154 to a proximal end segment 158. The proximal end segment 158 may extend generally along a longitudinal axis 127 while the center segment 156 and the distal segment 154 may be angled with respect to the longitudinal axis 127. For example, a first angle vertex 116 may be formed between the distal segment 154 and the center segment 156 and extend in an opposite direction from a second angle vertex 160 formed between the center segment 156 and the proximal segment 158. A distance between the first angle vertex 116 and a tip 118 of the distal end segment 154 define the width of the prong 108. The tip 118 of the distal end segment 154 may be pointed, for example, to puncture through a hole.

Figure 2:
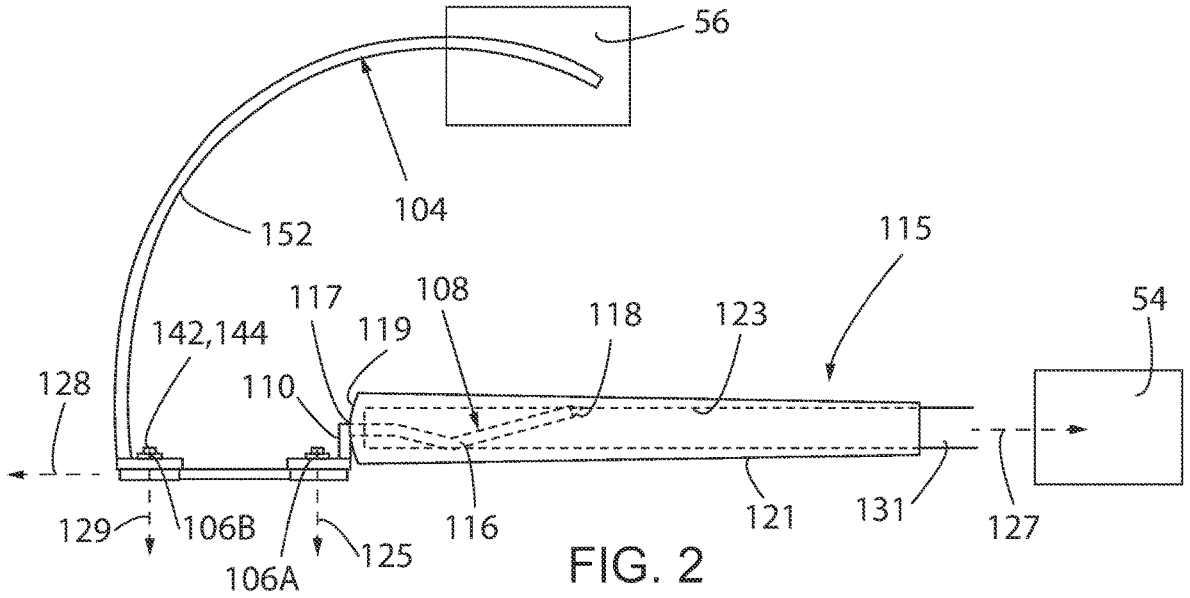
FIG. 2 is a side view of the first embodiment shown in FIG. 1*a* where the golf swing improvement tool is attached to the golf club.

Referring briefly to FIG. 2, a diameter of the prong 108 is sized to fit or puncture through a vent hole 117 of a grip 121 of a golf club 115 while a width between the tip 118 and the first angle vertex 116 may allow for the tip 118 and the first angle vertex 116 to fit snugly against the inner wall 123 of the grip 121 of the golf club 115, as further described below. The prong 108 may generally have a rectangular cross sectional shape but it is contemplated that other cross sectional shapes are possible, such as round, hexagonal, triangular, etc.

Referring again to FIGS. 1*a* and 1*b*, the proximal segment 158 of the prong 108 may be coupled to a spacer 110 extending perpendicular to the longitudinal axis 127 to be spaced from the longitudinal axis 127. The spacer 110 extends between the prong 108 and the offset arm 102 to separate the longitudinal axis 127 of the prong 108 from a longitudinal axis 128 of the offset arm 102. The offset distance between the longitudinal axis 127 and the longitudinal axis 128 may generally allow the offset arm 102 to clear the grip 121 of the golf club 115 as seen in FIG. 2.

The offset arm 102 may provide a pivot disk 111 at a first end 105 and a pivot disk 113 at the opposite second end 107 of the offset arm 102 and which have corresponding central holes 114B and 114C in the centers of the pivot disks 111 and 113. A length of the offset arm 102 may be about 80 mm to 100 mm and a distance between holes 114B and 114C of the offset arm 102 may be about 70 mm.

The spacer 110 may be attached to a pivot disk 112 of the offset arm 102 extending along the longitudinal axis 128 and supporting a central hole 114A extending through the pivot disk 112 along an axis of rotation 125 perpendicular to the longitudinal axis 128. The hole 114A may allow a bolt such as a hex bolt or screw to be passed through both the pivot disk 112 of the offset arm 102 and the pivot disk 112 of the base member 100 along the axis of rotation 125 for the creation of the positioning hinge 106A with the offset arm 102.

The guide arm 104 comprises of a substantially curved member 152 curving within the plane 56 and a pivot disk 109 located at a base of the curved member 152 and parallel to the plane 50. A tip of the curved member 152 may have rounded corners to reduce the chances of the curved member 152 from catching on the user's clothing. The pivot disk 109 may lie within the plane 50 of rotation of the offset arm 102. The pivot disk 109 may correspond to the pivot disk 113 of the offset arm 102, thereby having a central hole 114D extending through the pivot disk 109 and allowing a bolt or screw to pass through both the pivot disk 113 of the offset arm 102 and the pivot disk 109 of the guide arm 104 along an axis of rotation 129 for the creation of the positioning hinge 106B with the offset arm 102.

The two hinges 106A, 106B may be formed with a wing nut 142 and bolt 144. A washer made of compressible material can be positioned between the two connecting parts of each hinge to provide friction. Positioning hinges 106A and 106B have enough friction to maintain the relative positions of offset arm 102 and guide arm 104 throughout the user's swing. Alternatively, the lower surface of the upper pivot disks 109, 112 and the upper surface of the lower pivot disk 111, 113 of each hinge 106A, 106B may include teeth 62 on a perimeter of the pivot disks 109, 111, 112, 113 and mating with the other pivot disks 109, 111, 112, 113 to prevent movement of the pivot disks 109, 111, 112, 113 during a swing. The pivot disks 109, 111, 112, 113 may include indicator marks 64 so that the user can set the hinges 106A, 106B at desired angles and reset the angle easily for repeated use.

One skilled in the art can utilize other possible hinge designs such as a rivet, permanent pin, or more sophisticated connection types. The pivot disks 109, 111, 112, 113 may generally correspond in shape and size.

Referring again to FIG. 2, a side view of the first embodiment where a golf swing practice tool of this embodiment is secured to the golf club 115 is shown. The prong 108 of the base member 100 may be inserted into a vent hole 117 at the butt 119 of the handle or grip 121 of a standard golf club 115 so that the spacer 110 is touching the butt 119 of the club 115. The two opposed contact points, angle vertex 116 and tip 118, between prong 108 and the inner wall 123 of the shaft 131 of the club 115, allow base member 100 to be held in a stably fixed relationship with respect to the inner wall 123 within the club 115.

The prong 108 may be shaped to have two points of contact, angle vertex 116 and tip 118, against the inner wall 123 of the shaft 131 of the golf club 115. To achieve friction between the prong 108 and the inner wall 123 of the golf club 115, the distance between the angle vertex 116 and the tip 118 is about 0 mm to 5 mm greater than the inner diameter of a golf club shaft 131. The prong 108 is then designed to flex (e.g., compress vertically) when inserted into the golf club 115 resulting in constant pressure against the inner wall 123 of the golf club shaft 131 at the angle vertex 116 and the tip 118.

When the prong 108 is inserted within the golf club 115, the curved member 152 of the guide arm 104 has an arcuate shape curving downward towards the tip 118 of the base member 100 and toward the golf club shaft 131 or the club face 137 and generally terminating at a position along longitudinal axis 127 consistent with the position of the tip 118 of prong 108 when viewed from the side as seen in FIG. 2.

When attached to the golf club 115, the longitudinal axis 127 of the proximal segment 158 of the prong 108 may be aligned with the shaft 131 of the golf club 115. In this respect, the axis of rotation 125 of positioning hinge 106A and the axis of rotation 129 of positioning hinge 106B may be perpendicular to the longitudinal axis 127 and longitudinal axis 128. The axis of rotation 129 of positioning hinge 106B may be parallel to the axis of rotation 125 of positioning hinge 106A. The curved member 152 curves within the plane 56 which is generally perpendicular to the plane 50 of rotation of the offset arm 102 and parallel to a plane 54 the longitudinal axis 127 of the shaft 131 and the lower edge of the striking face 137.

After securing the golf practice tool to the club 115, the user adjusts the offset distance of guide arm 104 as further described below.

Figure 3:
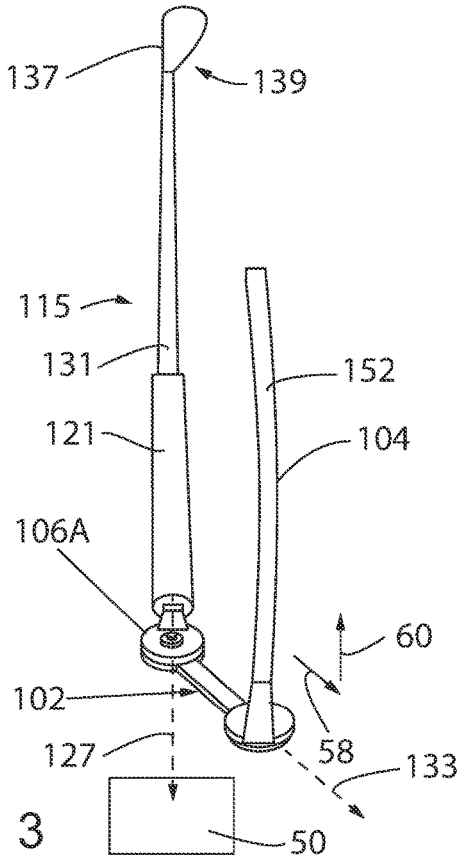
FIG. 3 is a top perspective view of the golf swing improvement tool attached to the golf club shown in FIG. 2.

FIG. 3 shows how the base member 100 is aligned so that the axis of rotation 125 of positioning hinge 106A is contained by the plane 54 that also contains the longitudinal axis 127 of the shaft 131 and the lower leading edge of the club face 137. The guide arm 104 may then be offset to a side, e.g., to the right side or inner side of the arm, of the longitudinal axis 127 of the shaft 131 by manipulation of the offset arm 102 via positioning hinges 106A and 106B thereby positioning the guide arm 104 within a plane 56 that is offset from the plane 54 of the longitudinal axis 127 of the shaft 131 and the lower edge of the striking face 137. This offset distance of guide arm 104 is adjustable by the user. This allows guide arm 104 to be offset in (i) a first direction 58 that lies within a plane 50 of rotation of the offset arm 102 that contains the shaft 131, and then in (ii) a second direction 60 that is perpendicular to the plane 50 of rotation of the offset arm 102 containing the shaft 131 so that the guide arm 104 extends within plane 56 substantially parallel to the plane 54 that contains the longitudinal axis 127 of the shaft 131 and the lower edge of the striking face 137.

Figure 4:
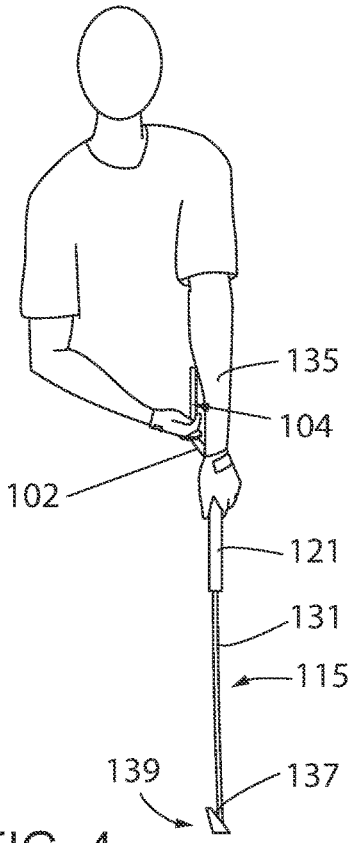
FIG. 4 is an illustration of the golf club being held by a user and an offset distance of a guide arm of the golf swing improvement tool being adjusted by the user.

FIG. 4 illustrates the offset distance of guide arm 104 being adjusted by the user. The optimal offset distance allows guide arm 104 to contact the inner side of the leading forearm 135 when a chosen relationship between the leading arm 135 and the club 115 is established. This optimal offset distance of guide arm 104 is found by carrying out the following steps. First, the user holds the club 115 in the leading hand using the gripping technique selected for the particular shot being played. Second, the golf club 115 and leading arm 135 are positioned in the relationship the user desires them to be in at impact (in FIG. 4 this is the in-line relationship). Third, the offset arm 102 and guide arm 104 are moved via positioning hinges 106A and 106B so that the guide arm 104 rests against the inner side of the leading forearm 135 while the plane 56 containing the guide arm 104 remains parallel to the plane 54 containing the longitudinal axis 127 of the shaft 131 and the lower edge of the striking face 137.

The adjustability of this embodiment is beneficial due to variations in the ideal offset distance of guide arm 104. The ideal distance of separation from the longitudinal axis 127 of the shaft 131 to the inner side of the leading forearm 135 is influenced by three factors: 1) the desired relationship of the leading arm 135 to the club 115, 2) the gripping style being used, and 3) the forearm 135 thickness of the user.

Figure 5A:
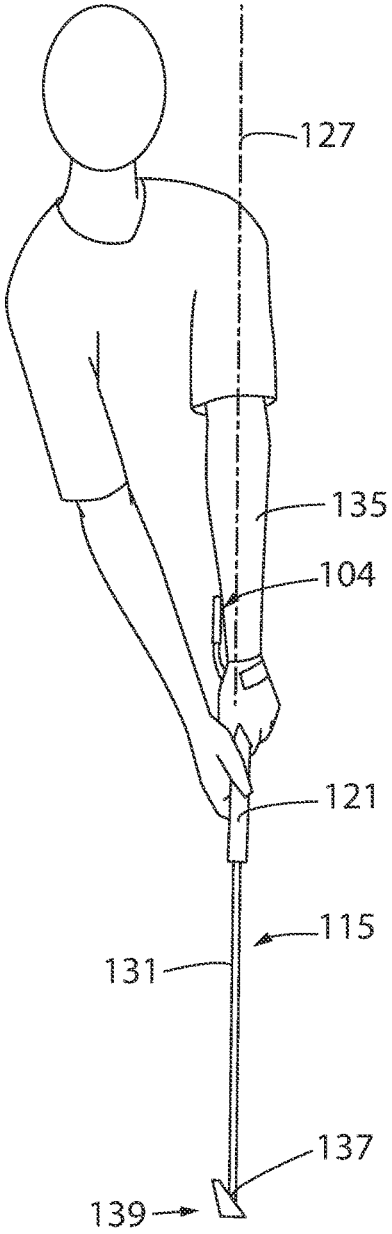
FIG. 5*a* is an illustration of a user's swing where the club head is in-line with the user's leading arm.
Figure 5B:
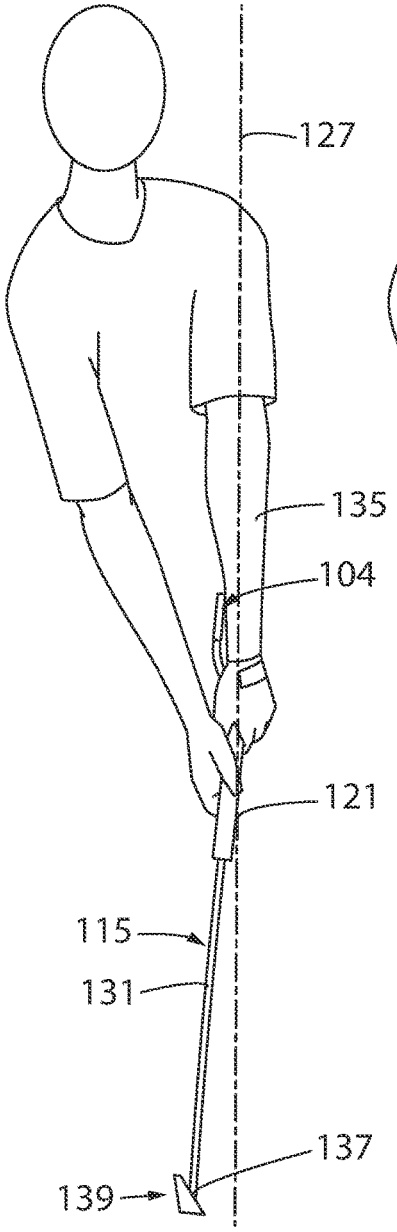
FIG. 5*b* is an illustration of a user's swing where the club head lags slightly behind the user's leading arm.
Figure 5C:
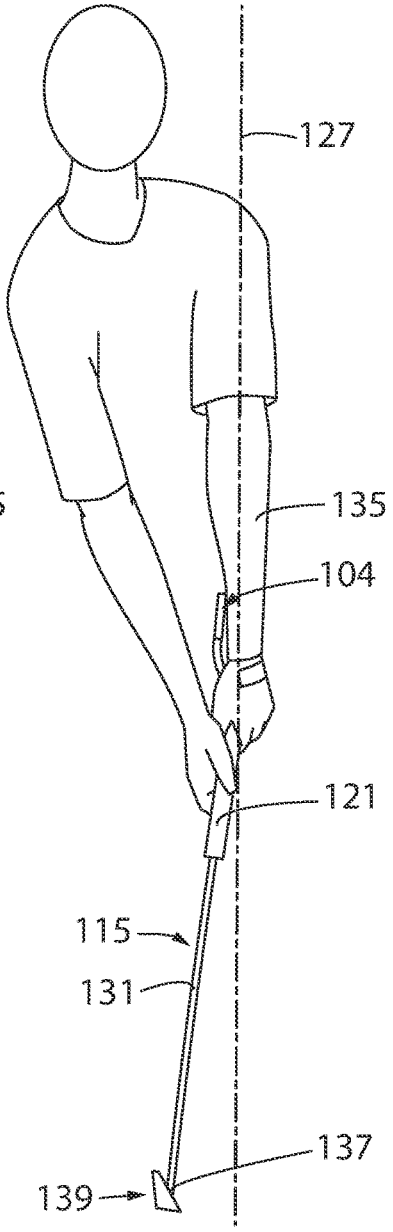
FIG. 5*c* is an illustration of a user's swing where the club head lags behind the user's leading arm more than FIG. 5*b;*

The first factor is the desired relationship between the club 115 and the leading arm 135. FIGS. 5*a*-5*c* show three separate swings employing different leading arm 135 to club 115 relationships. All three swings require the guide arm 104 to be offset from the longitudinal axis 127 of the shaft 131 by different amounts. In FIG. 5*a*, the user has chosen a relationship that has the club head 139 in-line with the leading arm 135. In FIG. 5*b*, the chosen relationship has the club head 139 lagging slightly behind the leading arm 135. In FIG. 5*c*, the club head 139 lags even more than in FIG. 5*b*. The separation distance from the longitudinal axis 127 of the shaft 131 to the inner side of the leading forearm 135 is greatest in FIG. 5*c* and is least in FIG. 5*a*. Therefore, the rearward-offset distance of guide arm 104 will be greatest in FIG. 5*c* and lowest in FIG. 5*a*. As can be seen through this example, the further the user chooses to have the club head 139 lagging behind the leading arm 135 at impact, the more offset guide arm 104 will be in order to contact the inner side of the leading forearm 135.

Figure 6A:
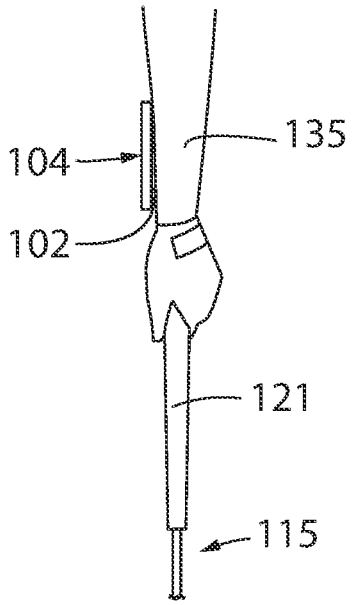
FIG. 6*a* is an illustration of the user gripping the club with a "strong" grip.
Figure 6B:
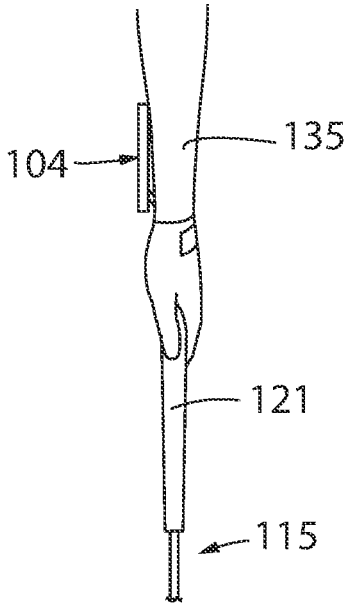
FIG. 6*b* is an illustration of the user gripping the club with a "weak" grip.

Referring to FIGS. 6*a* and 6*b*, the second factor affecting the offset distance of guide arm 104 is the gripping style being used. FIG. 6*a* shows the user gripping the club 115 with what is commonly called a "strong" grip. With such a grip, the hand of the leading arm 135 is pronated and the club 115 is held more in the fingers than in the palm. In FIG. 6*b* the user has what is commonly of the called a "weak" grip. The club 115 is held more in the palm than in the fingers. Between these two gripping styles there is a substantial difference in the position of the inner side of the leading forearm 135 in relation to the longitudinal axis 127 of the shaft 131. With the strong grip of FIG. 6*a*, the inner side of the leading forearm 135 is positioned further behind the longitudinal axis 127 of the shaft 131, in comparison to the weak grip of FIG. 6*b*. Therefore, the rearward offset distance of guide arm 104 will be greater for a strong grip than for a weak grip.

Figure 7A:
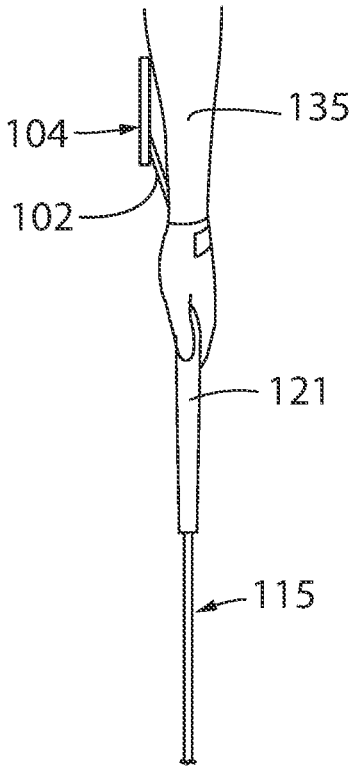
FIG. 7*a* is an illustration of the offset distance of the guide arm being greater for a user with broader forearms.
Figure 7B:
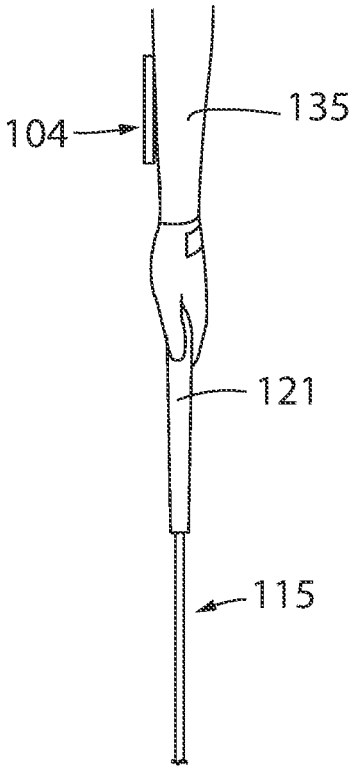
FIG. 7*b* is an illustration of the offset distance of the guide arm being smaller for a user with narrower forearms.

Referring to FIGS. 7*a* and 7*b*, the third factor affecting the offset distance of guide arm 104 is the width of the leading forearm 135. For a user with wider forearms 135 (FIG. 7*a*), the inner side of the leading forearm 135 is positioned further behind the longitudinal axis 127 of the shaft 131, in comparison to a user with narrower forearms 135 (FIG. 7*b*). In order to achieve the same club head 139 to leading arm 135 relationship, assuming the gripping styles are equal, the user with wider forearms 135 will utilize a greater rearward offset distance of guide arm 104 than the user with thinner forearms 135.

Figure 8A:
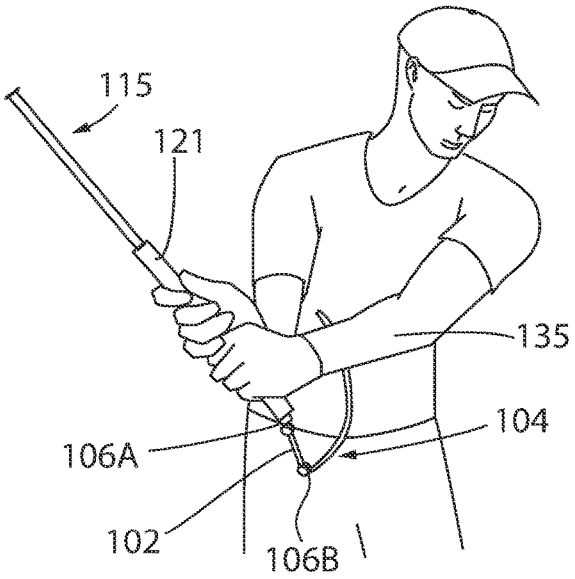
FIG. 8*a* is an illustration of an upswing position of the golf club as it is being swung by the user.
Figure 8B:
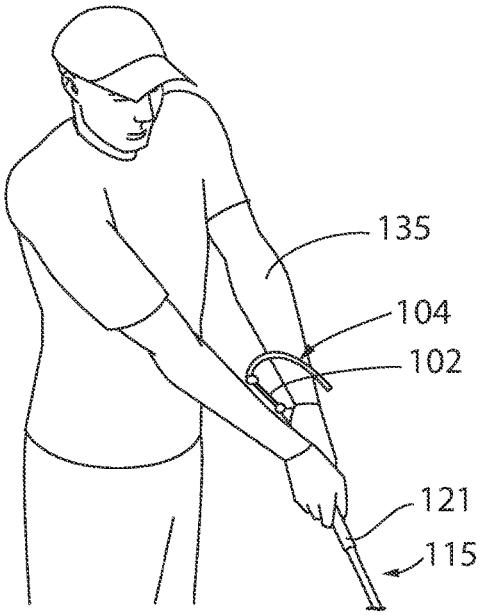
FIG. 8*b* is an illustration of a downswing position of the golf club as it is being swung by the user.

Referring to FIGS. 8*a* and 8*b*, a user swinging a club 115 is shown. During the swing, the guide arm 104 is contacting the inner side of the leading forearm 135. Constant contact between guide arm 104 and the leading forearm 135 throughout the swing indicates that the preselected relationship between the leading arm 135 and the golf club 115 is being properly maintained.

Figure 9A:
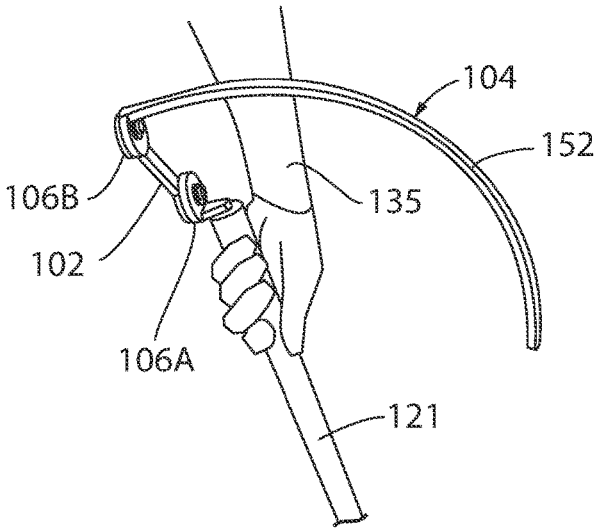
FIG. 9*a* is an illustration of the golf swing improvement tool being held by the user and a right-handed user's left wrist in an un-cocked position.
Figure 9B:
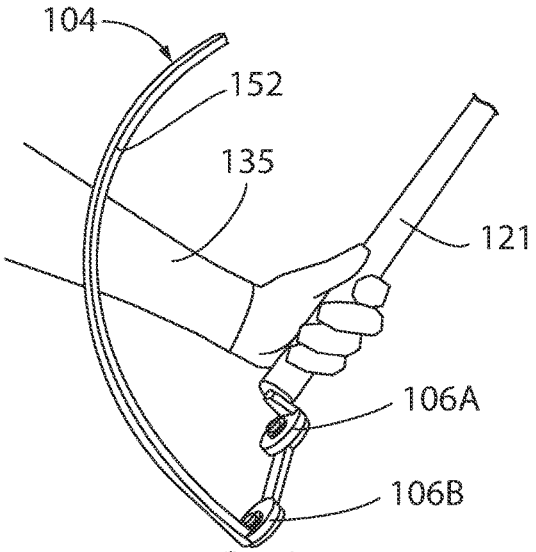
FIG. 9*b* is an illustration of the golf swing improvement tool being held by the user and a right-handed user's left wrist in a cocked position.

Referring to FIGS. 9*a* and 9*b*, a right-handed user's left wrist is shown in the un-cocked position (FIG. 9*a*) and in the cocked position (FIG. 9*b*). As can be seen, the arching shape of guide arm 104 of this embodiment enables it to contact the same region of the user's leading forearm 135 in both of these positions.

Figure 10:
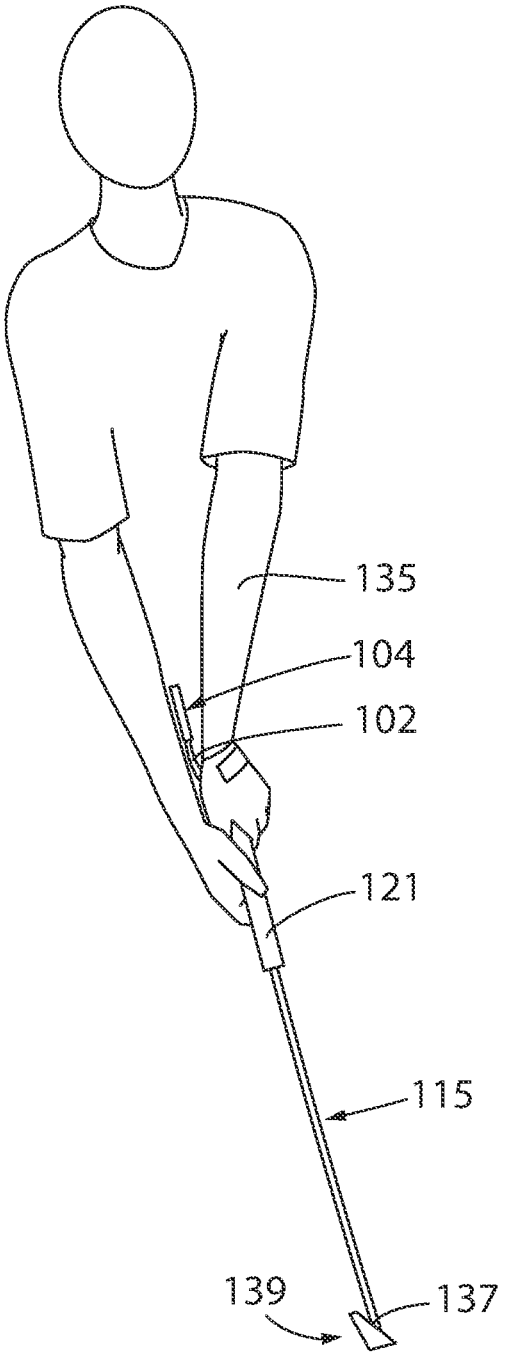
FIG. 10 is an illustration of an erroneous swing where the club has moved ahead of the user's leading arm.

Referring to FIG. 10 an erroneous swing is shown. The club 115 has moved ahead of the user's leading arm 135. With this embodiment, the user is made aware of this flaw as guide arm 104 loses contact with the inner side of the leading forearm 135.

After gaining the basic skill of maintaining guide arm 104 in contact with the forearm 135, the user can further refine this skill by experimenting with slight variations in the leading arm 135 to golf club 115 relationship. Such advanced learning is possible because the offset distance of guide arm 104 in this embodiment is adjustable. Slight variations in the leading arm 135 to golf club 115 relationship are achieved by making adjustments to the offset distance of guide arm 104. From one shot to the next, the user can choose a slightly different club-to-leading-arm relationship and maintain that relationship throughout the swing. This adjustable offset distance of guide arm 104 allows the user to experience the results of slight alterations in the leading-arm-to-club relationship.

Therefore, this adjustability helps the user acquire the skill of producing a range of ball behaviors. The ability to produce a range of different ball behaviors is a helpful skill for a golfer to learn.

Figure 11:
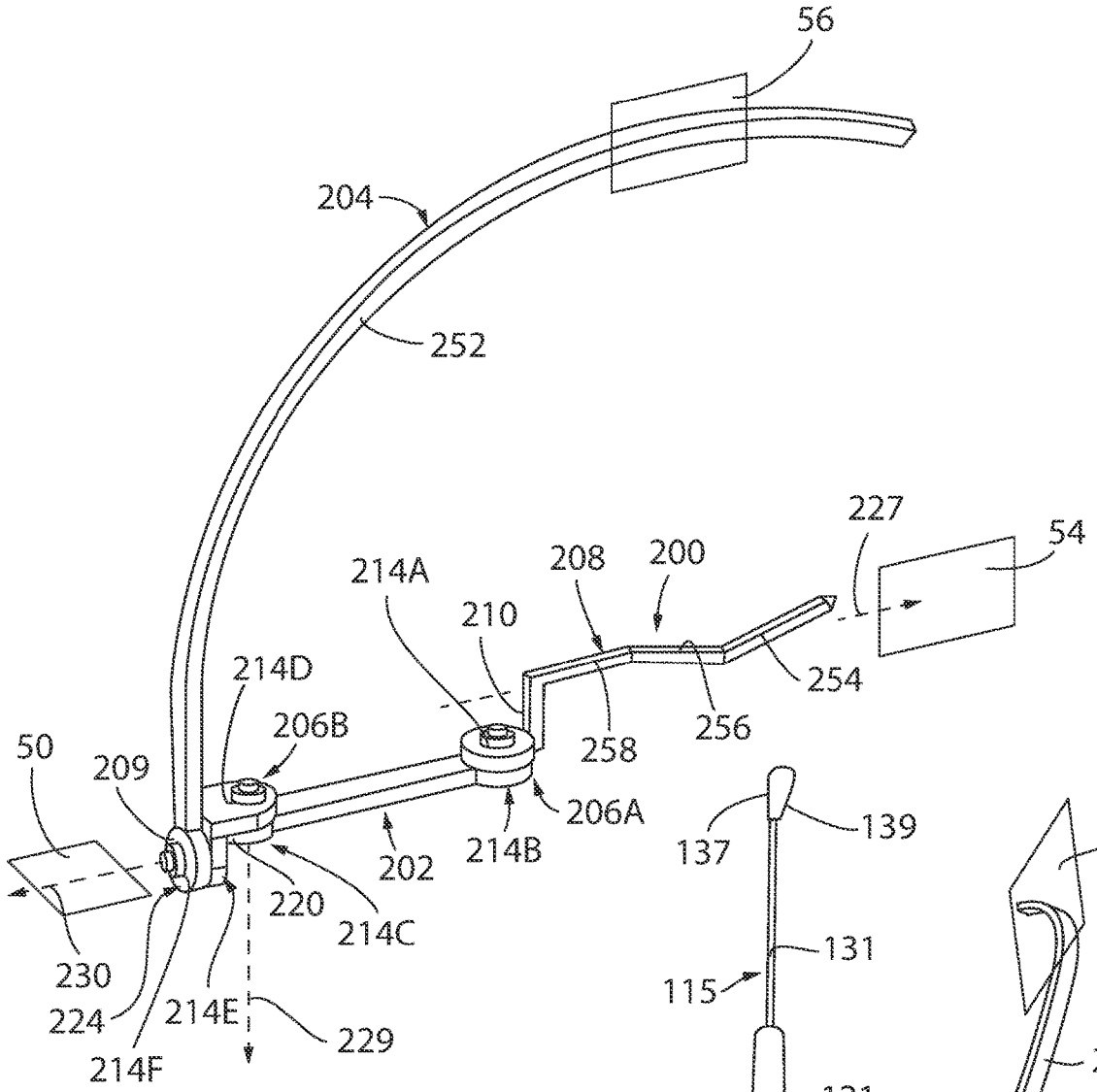
FIG. 11 is a perspective view of a second embodiment of the present invention showing a golf swing improvement tool attachable to a golf club.
Figure 12:
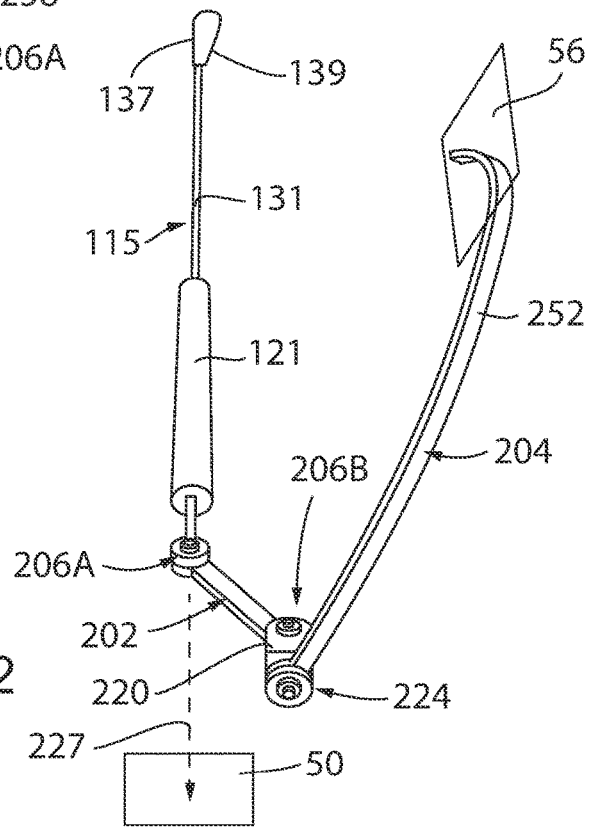
FIG. 12 is a top perspective view of the second embodiment shown in FIG. 11 secured to the golf club and showing how the tilting hinge enables a user to alter the angle of the guide arm.

Second Embodiment—FIGS. 11-12

FIG. 11 shows a perspective view of a second embodiment of the golf swing improvement tool 40. Elements of the second embodiment are similar to the first embodiment except for the addition of an L-shaped connector 220. Elements of the second embodiment that correspond to the first embodiment are designated by the same reference numeral, incremented by 100. A description of many of these elements is abbreviated or even eliminated in the interest of brevity.

As shown, this embodiment includes a base member 200 and an offset arm 202 that are similar to the first embodiment however the offset arm 202 is attached to the L-shaped connector 220 and a tiltable guide arm 204. The L-shaped connector 220 provides two perpendicular surfaces supporting a hole 214D extending along axis of rotation 229 and perpendicular to hole 214E extending along longitudinal axis 230. The surface supporting hole 214D is pivotally connected to offset arm 202 via positioning hinge 206B and the surface supporting perpendicular hole 214E is pivotally connected to the tiltable guide arm 204 via tilting hinge 224. The tiltable guide arm 204 has a pivot disk 209 located at the proximal base of the curved member 252 and extending perpendicular to the plane 50 (as opposed to parallel to the plane 50 as shown in the first embodiment) and supporting a hole 214F corresponding to the hole 214E of the L-shaped connector 220 to form the tilting hinge 224.

The tiltable guide arm 204 is pivotally connected to the L-shaped connector 220 about longitudinal axis 230. One skilled in the art will recognize that a ball and socket joint could be used instead of L-shaped connector 220 to connect the tiltable guide arm 204 directly to the offset arm 202. A ball and socket joint could be used to give generally the same range of motion that is achieved in this embodiment by the combination of positioning hinge 206B, L-shaped connector 220, and tilting hinge 224.

FIG. 12 illustrates how the tilting hinge 224 enables a user to alter the angle of the tiltable guide arm 204. Adjusting the angle of the tiltable guide arm 204 is done by holding the club 115 in one hand while gripping the tiltable guide arm 204 with the other, then applying pressure in the desired direction of movement. This enables the user to choose a customized plane 56 to guide the leading arm 135 wrist cock. The plane 56 may be angled with respect to plane 50 of rotation of the offset arm 102 and plane 54 of the longitudinal axis 127 of the shaft 131. This feature may be desirable to advanced players with individual preferences as to the precise plane of wrist cock.

This embodiment is then used in the same way as the first embodiment. The offset distance of tiltable guide arm 204 is adjusted to give the preselected club-to-leading arm relationship when tiltable guide arm 204 rests against the inside of the leading forearm 135. Throughout the swing the user tries to maintain tiltable guide arm 204 in contact with the inner side of the leading forearm 135.

Figure 13:
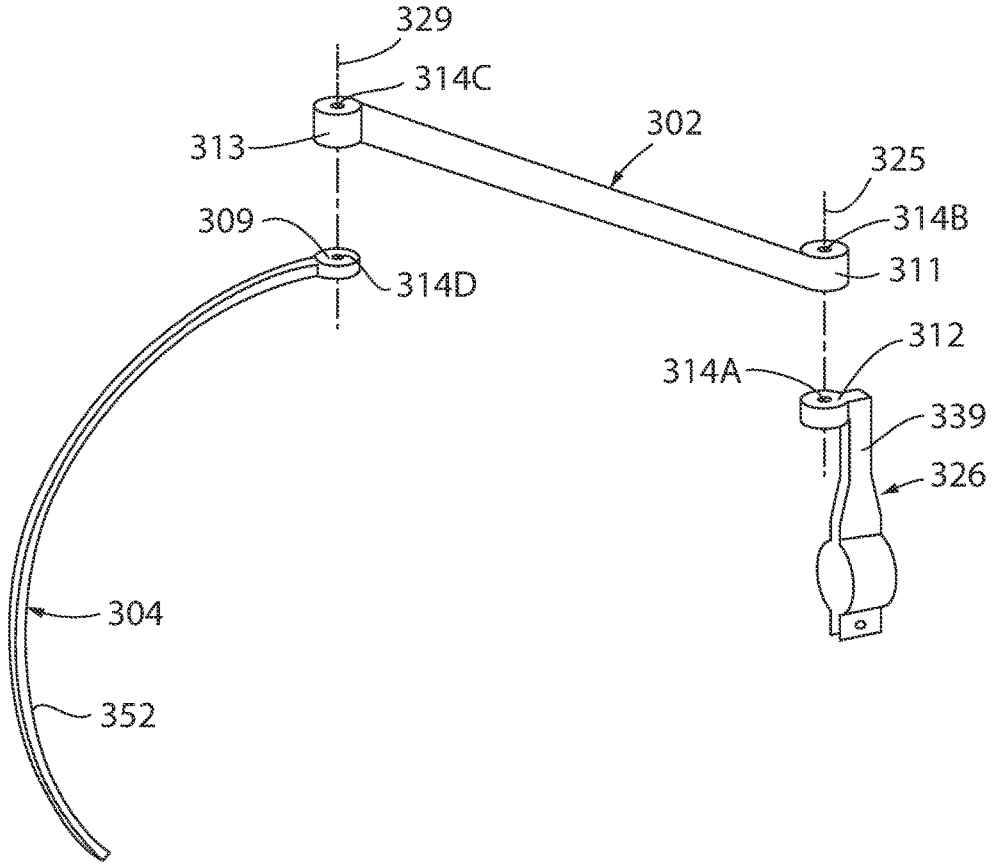
FIG. 13 is an exploded perspective view of a third embodiment of the present invention that is similar to the first embodiment shown in FIG. 1*a* except that the golf swing improvement tool attaches to the golf club beneath the hands of the user instead of at the butt of the club.
Figure 14:
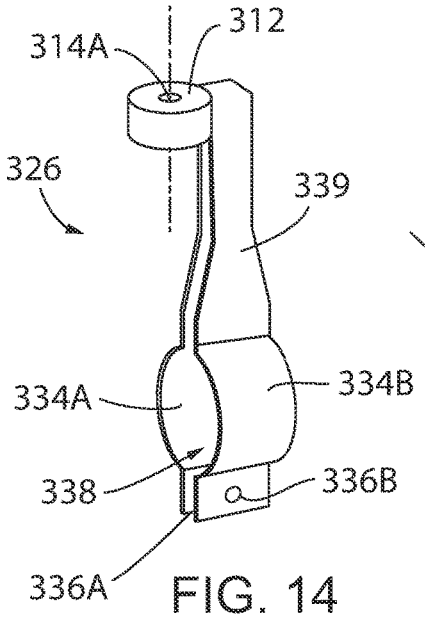
FIG. 14 is a perspective view of the attachment member of the third embodiment shown in FIG. 13.
Figure 15:
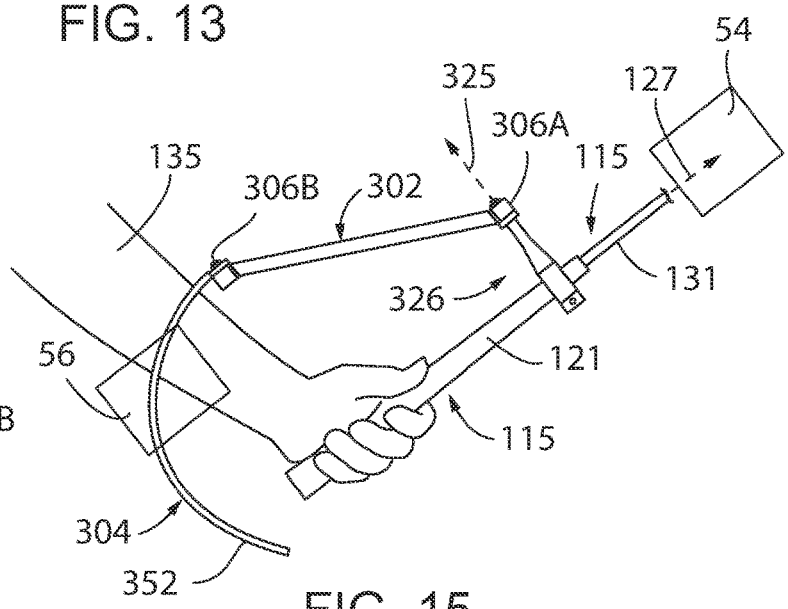
FIG. 15 is an illustration of the third embodiment shown in FIG. 13 with a user holding the golf club and the user's wrist fully cocked.

Third Embodiment—FIGS. 13-15

FIG. 13 illustrates a third embodiment that is similar to the first embodiment except that the golf swing improvement tool attaches to the golf club 115 beneath the hands of the user instead of at the butt 119 of the club 115. Elements of the third embodiment that correspond to the first embodiment are designated by the same reference numeral, incremented by 200. A description of many of these elements is abbreviated or even eliminated in the interest of brevity.

This third embodiment comprises an attachment member 326, instead of base member 100, an upwardly angled offset arm 302, and a descending guide arm 304. The upwardly angled offset arm 302 is pivotally connected to the attachment member 326 via a positioning hinge 306A. The descending guide arm 304 is pivotally connected to upwardly angled offset arm 302 via another positioning hinge 306B. The axis 325 of positioning hinge 306A is perpendicular to the longitudinal axis 127 of the golf club 115. The axis 329 of positioning hinge 306B is parallel to the axis 325 of the positioning hinge 306A.

FIG. 14 shows attachment member 326 alone. Attachment member 326 includes a clamp formed from two clamp wings 334A and 334B extending from a stem 339 below the positioning hinge 306A. A channel 338 is formed between clamp wings 334A and 334B to accommodate the shaft 131 of the golf club 115. Bracing may be formed between the stem 339 and the clamp wings 334A and 334B for additional support when the clamp wings 334A and 334B are spread apart to accommodate the shaft 131 of the golf club 115. The clamp wings 334A and 334B extend to a securing part where holes 336A and 336B are formed through each respective wing. Holes 336A and 336B are aligned to allow a securing bolt (not shown) to pass through holes 336A and 336B. The two wings 334A and 334B can be secured to the shaft 131 of the golf club 115 by tightening a wing nut (not shown) on a securing bolt (not shown) to urge the two wings 334A, 334B together over the shaft 131.

FIG. 15 shows a side view of this third embodiment with a user's wrist fully cocked. Upwardly angled offset arm 302 extends above the hands of the user (right hand not shown). The location of positioning hinge 306B is designed so that upwardly angled offset arm 302 does not contact the user's leading forearm 135 during a maximal wrist cock. It is also shown that descending guide arm 304 terminates substantially in line or below the longitudinal axis 127 of the shaft 131 in this embodiment.

The way in which this third embodiment is fitted to the golf club 115 is best seen in FIG. 15. The shaft 131 of the golf club 115 is fitted through channel 338 of clamp so that positioning hinge 306A is above the shaft 131 and upwardly angled offset arm 302 extends away from the club head 139 towards the butt end 119 of the golf club 115. The wings 334A, 334B of the clamp will normally need to be spread apart to fit over the shaft 131. The final positioning of the clamp along the shaft 131 is achieved as shown in FIG. 15.

The golf club 115 is held in the hand of the leading arm 135 and the clamp is moved axially along the shaft 131 until the arc of the guide arm 304 is centered about the radius/ulnar joint of the leading arm 135. The attachment member is then aligned so that the plane 54 containing both the shaft 131 and the lower edge of the striking face 137 also contains the axis 325 of the positioning hinge 306A. The clamp is secured to the golf club 115 by tightening the two wings 334A and 334B using the securing bolt (not shown) and wing nut (not shown) underneath the shaft 131.

This embodiment is then used in the same fashion as the first embodiment. The offset distance of the guide arm 304 is adjusted to give the preselected club-to-leading arm relationship when guide arm 304 rests against the inside of the leading forearm 135. Throughout the swing the user tries to maintain guide arm 304 in contact with the inner side of the leading forearm 135.

One advantage of this embodiment is that it can be attached to older clubs 115 that do not have a vent hole 117 in the butt 119 of the grip 121.

Figure 16:
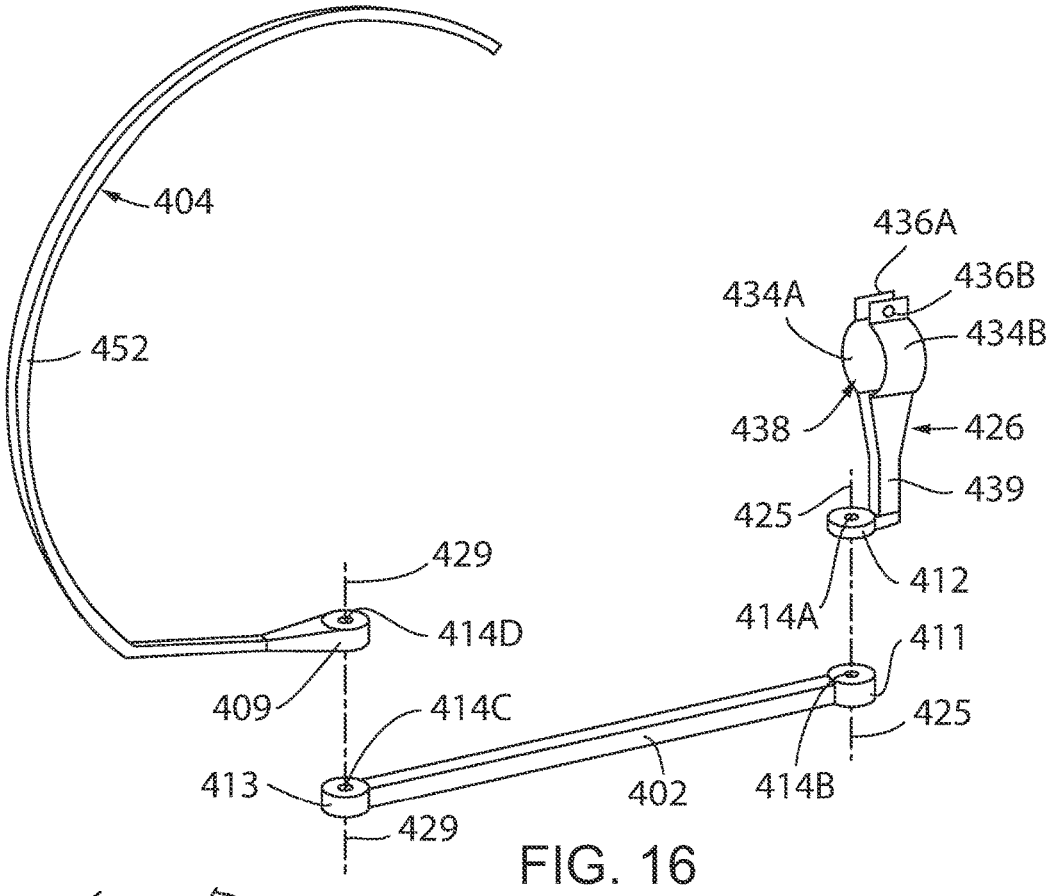
FIG. 16 is an exploded perspective view of a fourth embodiment of the present invention similar to the third embodiment shown in FIG. 13 except that the attachment member, elongated offset arm, and the guide arm extend below the shaft of the golf club instead of above.
Figure 17:
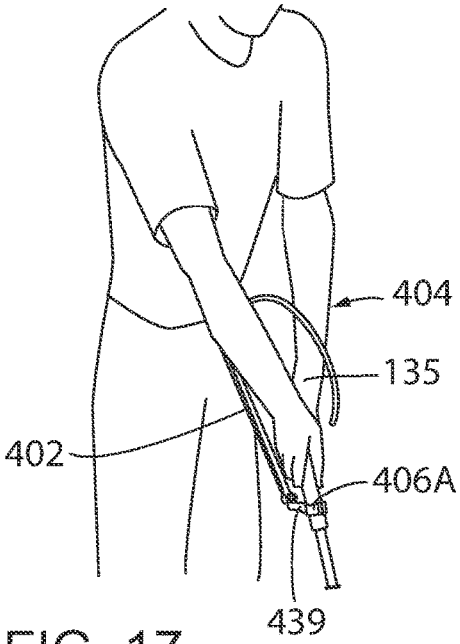
FIG. 17 is an illustration of the golf swing improvement tool held by a user and the length of the stem designed to provide a sufficient clearance distance between the elongated offset arm and the grip of the golf club so that the user can hold the golf club without his or her fingers being obstructed.
Figure 18:
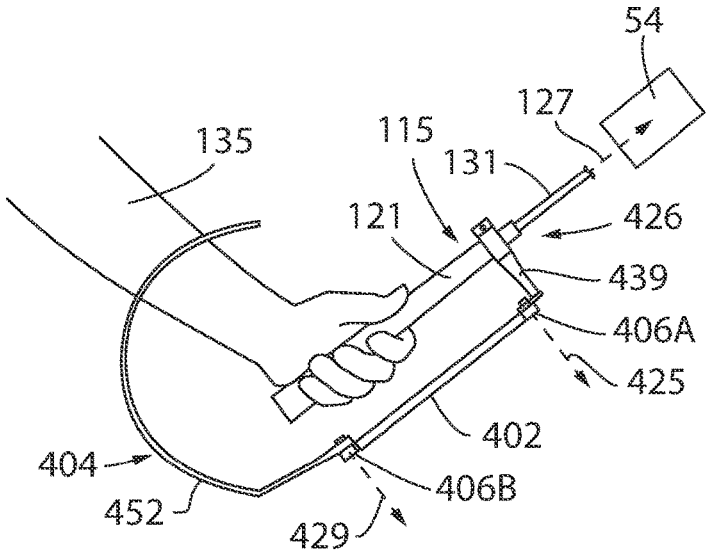
FIG. 18 is a side view of the fourth embodiment shown in FIG. 16 with a user holding the golf club and showing a final positioning of the clamp along the shaft.

Fourth Embodiment—FIGS. 16-18

FIG. 16 illustrates a fourth embodiment of the golf swing improvement tool similar to the third embodiment except that the attachment member 426, elongated offset arm 402, and the guide arm 404 extend below the shaft 131 of the golf club 115 instead of above. Elements of the fourth embodiment that correspond to the third embodiment are designated by the same reference numeral, incremented by 100. A description of many of these elements is abbreviated or even eliminated in the interest of brevity.

This embodiment has an attachment member 426 that attaches to the golf club 115 below the hands of the user. An elongated offset arm 402 passes under the grip 121 of the golf club 115. An arching guide arm 404 curves upwardly to contact the inner side of the user's forearm 135. The elongated offset arm 402 is pivotally connected to the attachment member 426 via a positioning hinge 406A. Guide arm 104 is pivotally connected to the elongated offset arm 402 via a positioning hinge 406B. Positioning hinge 406A has an axis 425 that is perpendicular to the longitudinal axis 127 of the shaft 131. The axis 429 of positioning hinge 406B is parallel to the axis 425 of positioning hinge 406A.

The attachment member 426 comprises a clamp, similar to the attachment member 326 shown in the third embodiment, including two clamp wings 434A and 434B extending from a stem 439, forming between the wings 434A, 434B in a central portion of the clamp a channel 438 to accommodate the shaft 131 of the golf club 115. The wings 434A and 434B extend to a securing part where holes 436A, 436B are formed through each respective wing, where the holes 436A, 436B are aligned for passage therethough of a securing bolt (not shown). The two wings 434A and 434B can be secured to the shaft 131 of a golf club 115 by tightening a wing nut (not shown) on the securing bolt (not shown) to urge the two wings 434A, 434B together over the shaft 131.

FIGS. 17-18 show how the length of the stem 439 is designed to provide a sufficient clearance distance between elongated offset arm 402 and the grip of the golf club 115 so that the user can hold the golf club 115 without his or her fingers being obstructed. Guide arm 404 extends from positioning hinge 406B in a curved shape to terminate substantially in line with the longitudinal axis 127 of the shaft 131 or generally above the hands of the user.

The way in which this embodiment is fitted to the golf club 115 is best seen in FIG. 18. The shaft 131 of the golf club 115 is fitted through channel 438 of the clamp so that positioning hinge 406A is below the shaft 131 and elongated offset arm 402 extends away from the club head 139 towards the butt end 119 of the golf club 115. The wings 434A and 434B of the clamp will normally need to be spread apart to fit over the shaft 131. The final positioning of the clamp along the shaft 131 is achieved as shown in FIG. 18.

The golf club 115 is held in the hand of the leading arm 135 and the clamp is moved axially along the shaft 131 until the arc of the guide arm 404 is centered about the radius/ulnar joint of the leading arm 135. Attachment member 426 is then aligned so that the plane 54 containing both the shaft 131 and the lower edge of the striking face 137 also contains the axis 425 of the positioning hinge 406A. Attachment member 426 is secured to the golf club 115 by tightening the wing nut above the shaft 131.

This embodiment is then used in the same way as the first embodiment. The offset distance of guide arm 404 is adjusted to give the preselected club-to-leading arm relationship when guide arm 404 rests against the inside of the leading forearm 135. Throughout the swing the user tries to maintain guide arm 404 in contact with the inner side of the leading forearm 135.

One advantage of this embodiment is that offset arm 402 is mostly out of the user's field of vision. Another advantage is that it can be attached to older clubs 115 that do not have a vent hole 117 in the butt 119 of the grip 121.

Figure 19:
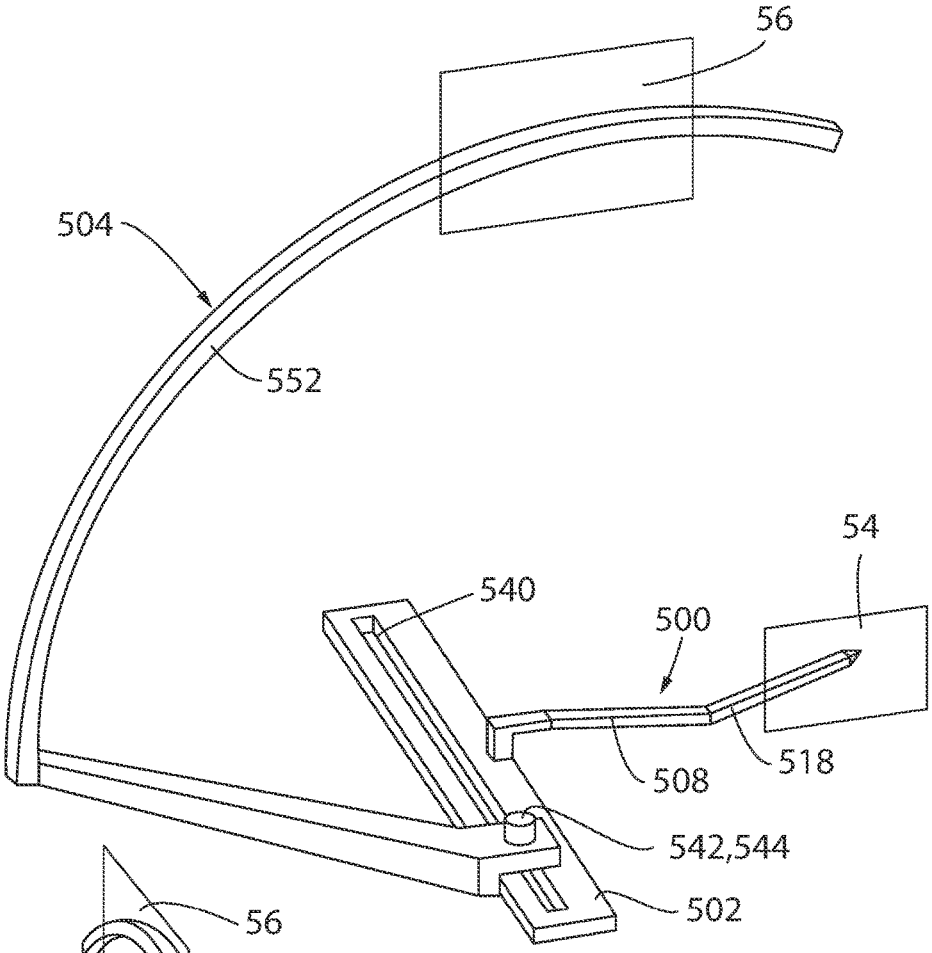
FIG. 19 is a perspective view of a fifth embodiment of the present invention with a different type of offset arm that allows sliding of the guide arm.
Figure 20:
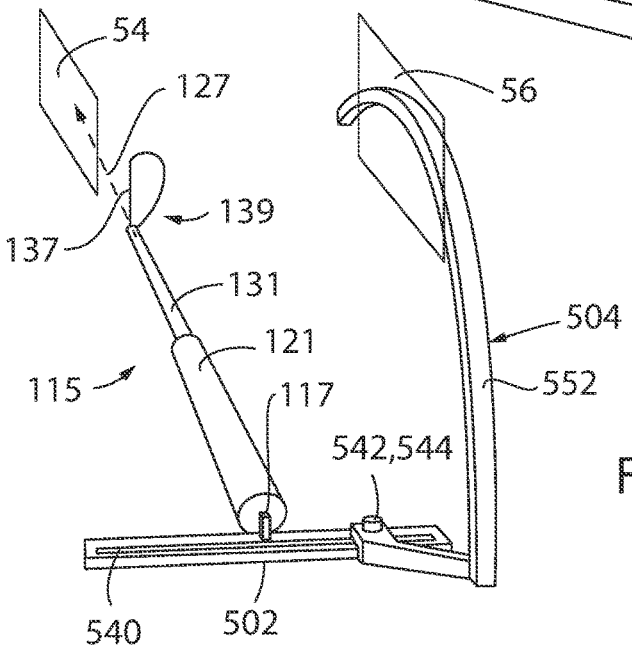
FIG. 20 is a top perspective view of the fifth embodiment shown in FIG. 19 showing the fifth embodiment shown in FIG. 19 attached to the golf club.

Fifth Embodiment—FIGS. 19-20

FIG. 19 illustrates a fifth embodiment with a different type of offset arm that allows sliding of the guide arm. Elements of the fifth embodiment that correspond to the first embodiment are designated by the same reference numeral, incremented by 400. A description of many of these elements is abbreviated or even eliminated in the interest of brevity.

The fifth embodiment, as shown, comprises a base member 500 and a sliding guide arm 504. The base member 500 includes a curved prong 508, a projection 518, and a shelf 502. The shelf 502 contains a slot 540 that extends within plane 50 of sliding of the offset arm 102 and is perpendicular to plane 54 of the longitudinal axis 127 of the shaft 131 and the lower edge of the striking face 137 and perpendicular to plane 56 of the curved prong 508. Sliding guide arm 504 is secured to the shelf 502 by a bolt 544 and a wingnut 542.

FIG. 20 illustrates how this fifth embodiment is attached to a golf club 115. Curved prong 508 is inserted into the vent hole 117 of the golf club 115. The shelf 502 is aligned within plane 50 perpendicular to the plane 54 containing the shaft 131 and leading edge of the striking face 137. The offset distance of sliding guide arm 504 is adjusted by loosening wingnut 542, positioning sliding guide arm 504 at the desired location along shelf 502, and then tightening wingnut 542 on bolt 544.

This embodiment is then used in the same way as the first embodiment. The offset distance of guide arm 504 is adjusted to give the preselected club-to-leading arm relationship when guide arm 504 rests against the inside of the leading forearm 135. Throughout the swing the user tries to maintain guide arm 504 in contact with the inner side of the leading forearm 135.

One advantage of this embodiment is that the plane 56 containing the guide arm 504 is always parallel to the plane 54 containing the shaft 131 and leading edge of the striking face 137.

Figure 21:
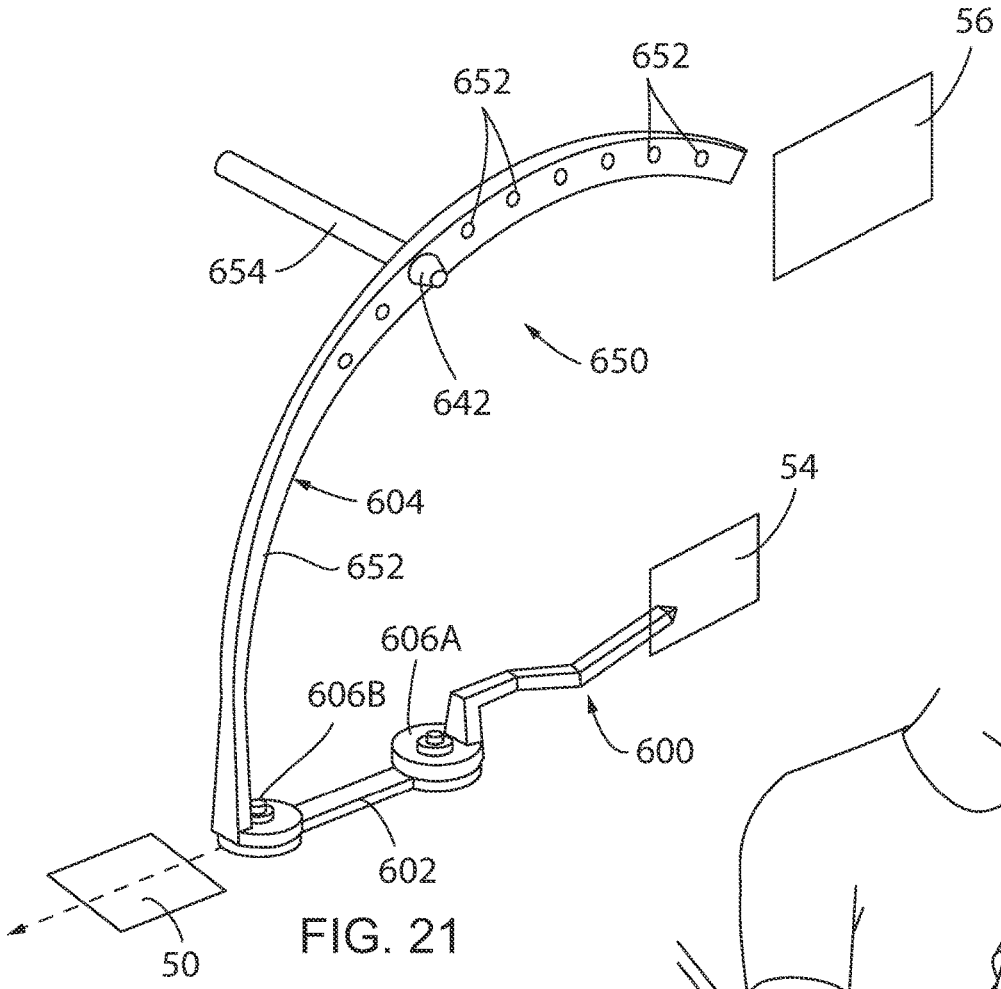
FIG. 21 is a perspective view of a sixth embodiment of the present invention that includes an optional bar assembly with a series of apertures formed along a guide arm.
Figure 22:
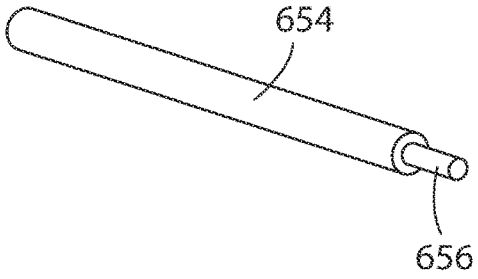
FIG. 22 is a perspective view of a stop bar to be used with the sixth embodiment shown in FIG. 21.
Figure 23:
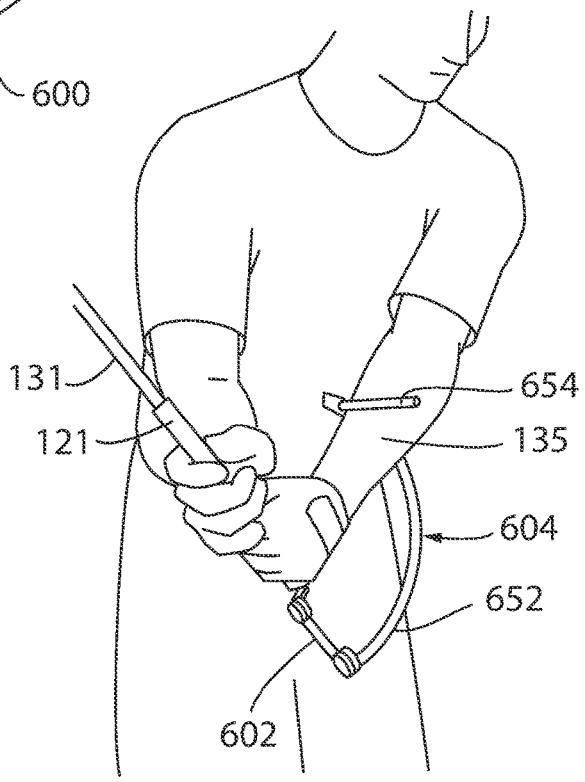
FIG. 23 is an illustration of the sixth embodiment shown in FIG. 21 being used by a golfer.

Sixth Embodiment—FIGS. 21-23

FIG. 21 shows a perspective view of a sixth embodiment that includes an optional bar assembly 650 with a series of apertures 652 formed along a guide arm 604. Elements of the sixth embodiment that correspond to the first embodiment are designated by the same reference numeral, incremented by 500. A description of many of these elements is abbreviated or even eliminated in the interest of brevity.

The bar assembly 650 comprises a stop bar 654 attached to the guide arm 604 and disposed perpendicular to the plane 56 containing the guide arm 604. The stop bar 654 is removably bolted to the guide arm 604 through a selected one of apertures 652 extending along the guide arm 604.

FIG. 22 illustrates the stop bar 654. A threaded bolt 656 (threads not shown) extends axially from the stop bar 654 to project through any of the apertures 652. The bolted connection is formed by tightening a wingnut 642 onto threaded bolt 656.

FIG. 23 shows this sixth embodiment being used by a golfer. A desired maximum angle of wrist cock is determined. Stop bar 654 is then bolted in position through the appropriate aperture 652 that results in stop bar 654 contacting the radial side of the user's leading forearm 135 when the determined angle of maximum wrist cock has been reached. During the initial downswing, continued contact between the user's arm 135 and stop bar 654 indicates maintenance of the predetermined maximum wrist cock angle. This is useful feedback as a powerful stroke results from delaying the release of the wrist cock until the hands are near the impact position.

Figure 24:
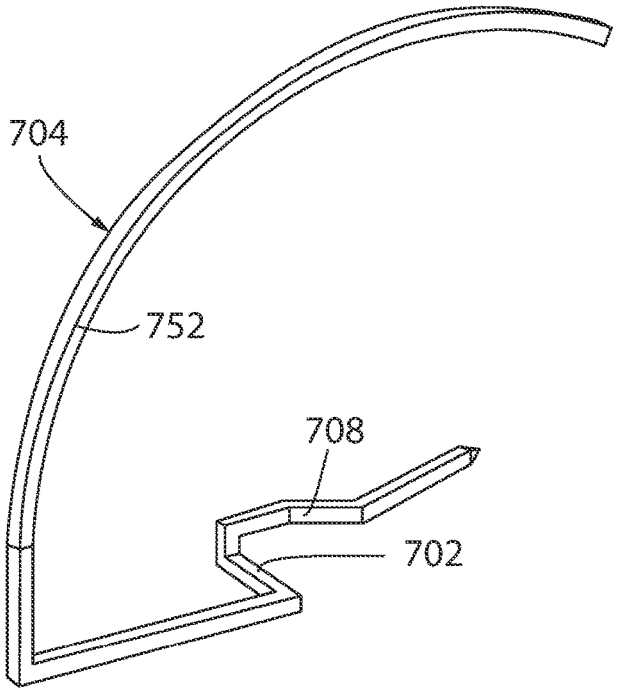
FIG. 24 is a perspective view of a seventh embodiment of the present invention that is similar to the first embodiment shown in FIG. 1*a* except that the entire golf swing improvement tool is formed as a unitary member with no adjustable components.

Seventh Embodiment—FIGS. 24-25

FIG. 24 illustrates a seventh embodiment that is similar to the first embodiment except that the entire practice tool is formed as one unit with no adjustable components. Elements of the seventh embodiment that correspond to the first embodiment are designated by the same reference numeral, incremented by 600. A description of many of these elements is abbreviated or even eliminated in the interest of brevity.

A lateral arm 702 offsets guide arm 704 by a fixed distance. A variety of versions of this embodiment can be manufactured and can be sold as a kit. With each version, lateral arm 702 will have different lengths to suit specific leading arm-to-club relationships for individual users. Lateral arm 702 can be designed to extend left or right of the curved prong 708. For example, forming this embodiment with lateral arm 702 extending to the left of curved prong 708 would be useful for left handed golfers.

Figure 25A:
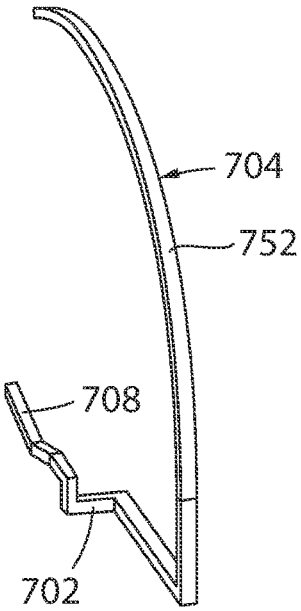
FIGS. 25*a*, 25*b*, and 25*c* are top perspective views of three versions of the seventh embodiment shown in FIG. 24 having different lengths of the lateral arm.
Figure 25B:
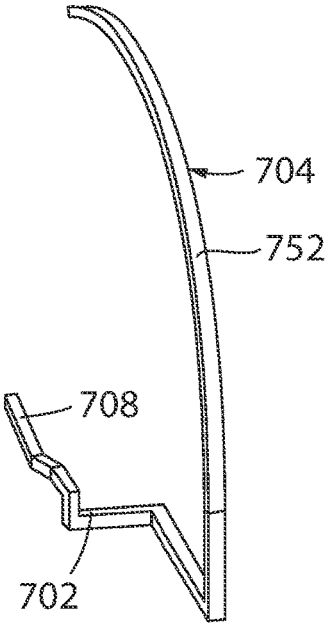
Figure 25C:
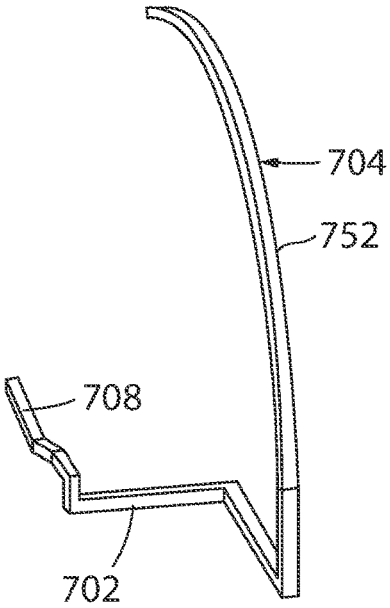

The user may have available several versions of this embodiment in a kit, each having a unique length of lateral arm 702. FIGS. 25*a*, 25*b*, and 25*c* show three versions of this embodiment that have different lengths of lateral arm 702. The user can select the version that facilitates the desired relationship between the golf club 115 and the leading arm 135 when guide arm 704 contacts the inner side of the leading forearm 135. The chosen version is attached to the club 115 by inserting the curved prong 708 into the vent hole 117 of the club 115 as it is with the first embodiment. Throughout the swing the user tries to maintain guide arm 704 in contact with the inner side of the leading forearm 135.

Figure 26:
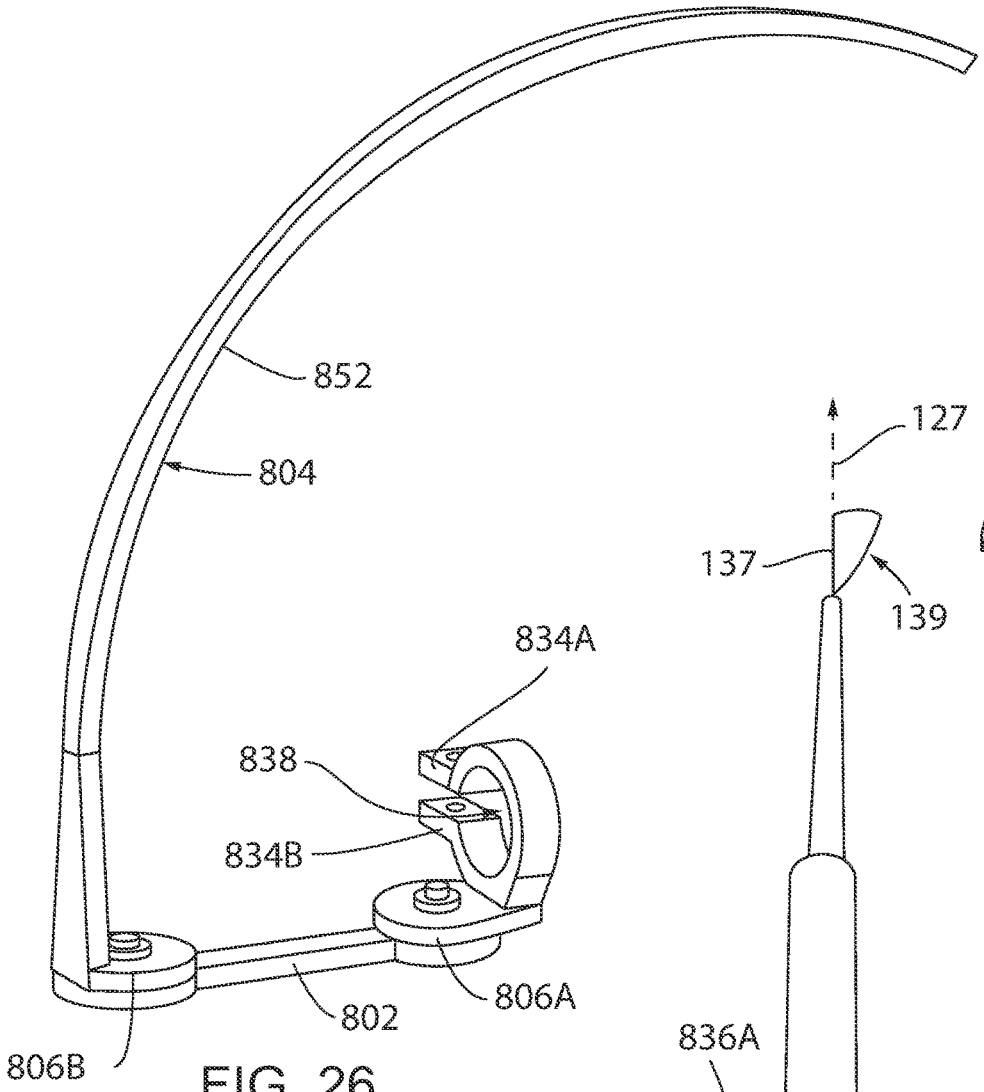
FIG. 26 is a perspective view of an eighth embodiment of the present invention that is similar to the third embodiment shown in FIG. 13 and fourth embodiment shown in FIG. 16 except that a clamp is designed to attach to the end of the grip above the hands of the golfer instead of below the hands of the golfer.
Figure 27:
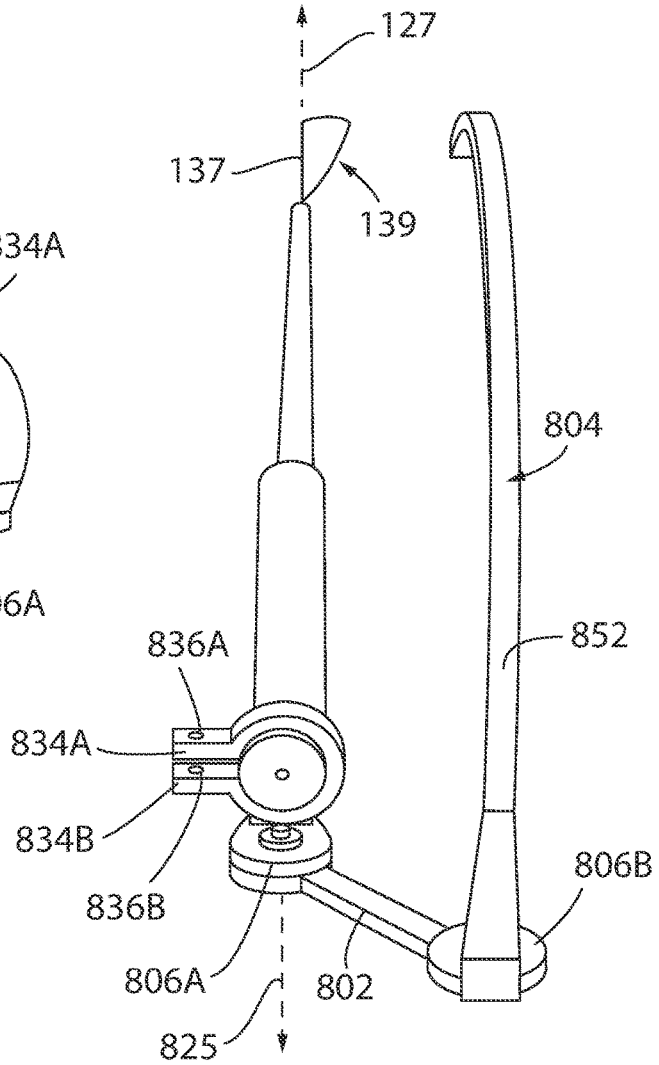
FIG. 27 is a top perspective view of the eighth embodiment shown in FIG. 26 showing the golf swing improvement tool attached to the golf club.

Eighth Embodiment—FIGS. 26-27

FIG. 26 shows an embodiment that is similar to the third and fourth embodiments except that a clamp 826 is designed to attach to the end of the grip 121 above the hands of the golfer instead of below the hands of the golfer. Elements of the eighth embodiment that correspond to the first embodiment are designated by the same reference numeral, incremented by 700. A description of many of these elements is abbreviated or even eliminated in the interest of brevity.

The clamp 826 comprises two clamp wings 834A and 834B that extend to a securing part where holes 836A, 836B are formed through each respective wing 834A, 834B. A bolt (not shown) passes through each hole 836A, 836B and a wingnut (not shown) is tightened onto the bolt (not shown) to securely attach the clamp 826 to the golf club 115. Also included in this embodiment are positioning hinges 806A, 806B, offset arm 802, and guide arm 804 all of which are shown in the first embodiment.

The butt end 119 of the golf club 115 is fitted through a channel 838 of the clamp 826 so that the axis 825 of positioning hinge 806A lies within the plane 54 that contains the longitudinal axis 127 of the shaft 131 and the lower edge of the striking face 137. The wings 834A and 834B of the clamp 826 will normally need to be spread apart to fit over the shaft 131. Clamp 826 is secured to the golf club 115 by tightening the wing nut at the side of the shaft 131.

This embodiment is then used in the same way as the first embodiment. The offset distance of guide arm 804 is adjusted to give the preselected club-to-leading arm relationship when guide arm 804 rests against the inside of the leading forearm 135. Throughout the swing the user tries to maintain guide arm 804 in contact with the inner side of the leading forearm 135.

One advantage of this embodiment is that it can be attached to older clubs 115 that do not have a vent hole 117 in the butt 119 of the grip 121 while having a relatively short offset arm compared to embodiments that attach below the hands of the user.

Figure 28:
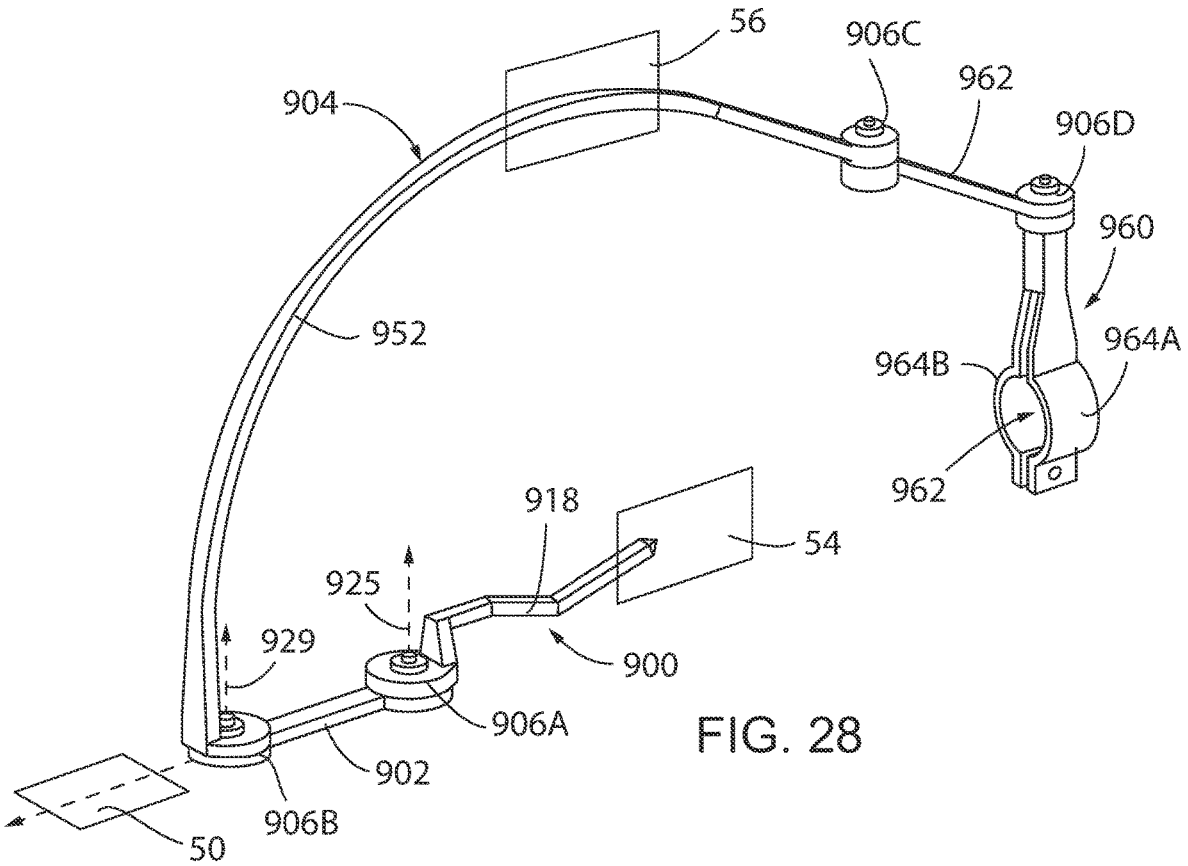
FIG. 28 is a perspective view of a ninth embodiment of the present invention that is similar to the first embodiment shown in FIG. 1*a* except that it has two attachments to a golf club, the second attachment member found at the end of the guide arm.
Figure 29:
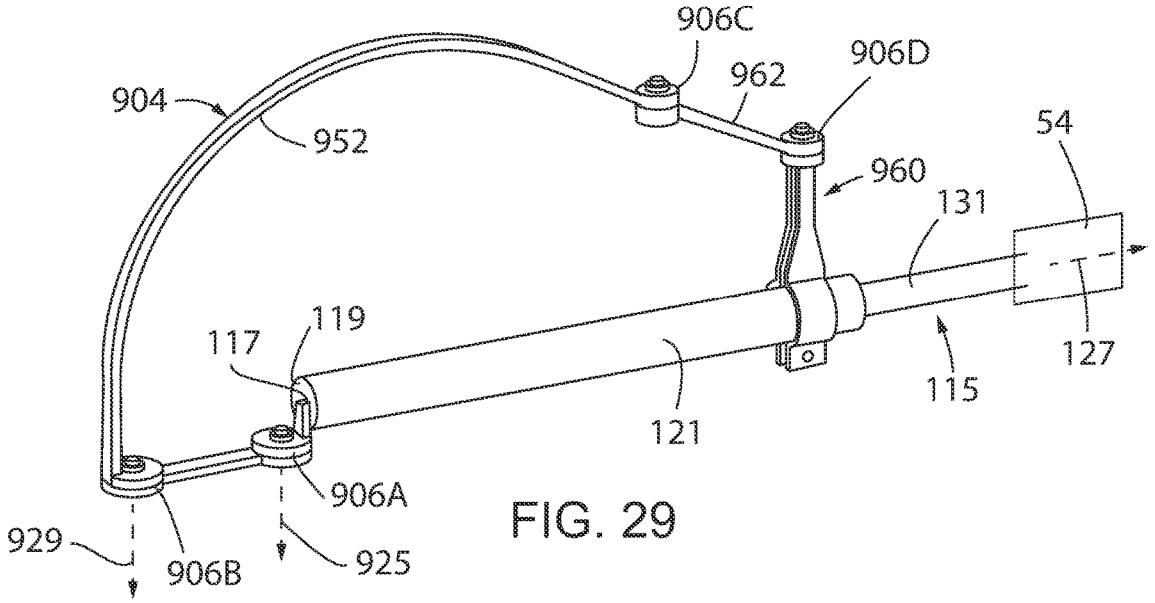
FIG. 29 is a perspective view showing the ninth embodiment shown in FIG. 28 attached to a golf club.

Ninth Embodiment—FIGS. 28-29

FIG. 28 illustrates an embodiment that is similar to the first embodiment except that it has two attachments to a golf club, the second attachment member found at the end of the guide arm. Elements of the ninth embodiment that correspond to the first embodiment are designated by the same reference numeral, incremented by 800. A description of many of these elements is abbreviated or even eliminated in the interest of brevity.

This embodiment includes an attachment member 960, an offset arm 962, a guide arm 904, offset arm 902, and base 900. Also included are four hinges. A first positioning hinge 906A connects the base 900 to the offset arm 902. A second positioning hinge 906B connects the offset arm 902 to the guide arm 904. A third positioning hinge 906C connects the guide arm 904 to offset arm 962. A fourth positioning hinge 906D connects the offset arm 962 to attachment member 960. This distance between the axis of positioning hinge 906A and positioning hinge 906B is equal to the distance between the axis of positioning hinge 906C and positioning hinge 906D.

FIG. 29 shows how this embodiment attaches to a golf club 115. First, the shaft 131 of the golf club 115 is fitted through channel 961 of the clamp so that positioning hinge 906D is above the shaft 131. The wings 964A, 964B of the clamp will normally need to be spread apart to fit over the shaft 131. Next, curved prong 918 is inserted, as far as it will go, into the vent hole 117 at the butt 119 the golf club 115. The axis 925 of positioning hinge 906A and axis 929 of positioning hinge 906B are aligned with the plane 54 that contains both the longitudinal axis 127 of the shaft 131 and the lower edge of the striking face 137. Attachment member 960 is secured to the club 115 through tightening wing nut (not shown) on the bolt (not shown).

This embodiment is then used in the same way as the first embodiment. The offset distance of guide arm 904 is adjusted to give the preselected club-to-leading arm relationship when guide arm 904 rests against the inside of the leading forearm 135. Throughout the swing the user tries to maintain guide arm 904 in contact with the inner side of the leading forearm 135.

One advantage of this embodiment is the additional stability provided to guide arm 904 by having two attachments to the club 115. The added stability allows this embodiment to be constructed from less rigid materials.

Figure 30A:
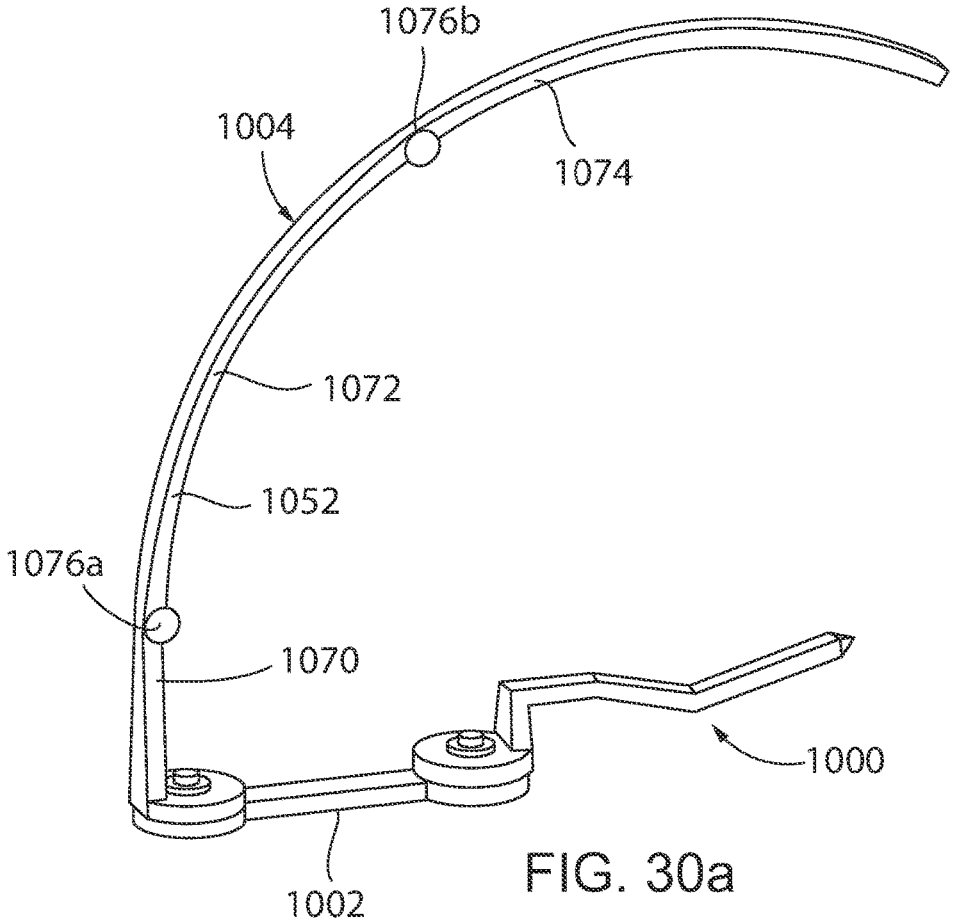
FIG. 30*a* is a perspective view of a tenth embodiment of the present invention that is similar to the first embodiment shown in FIG. 1*a* except that the guide arm is collapsible for storage and showing the guide arm in an operating position.
Figure 30B:
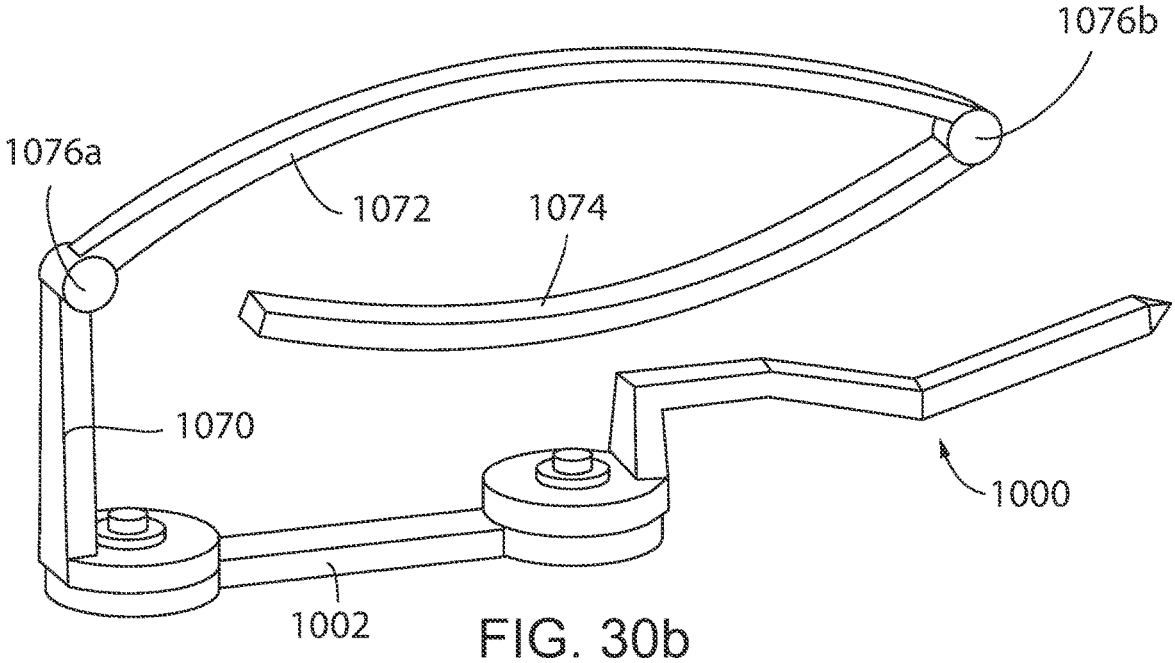
FIG. 30*b* is a perspective view of the tenth embodiment shown in FIG. 30*a* collapsed into a storage position.

Tenth Embodiment—FIGS. 30*a*-30*b*

FIG. 30*a* illustrates a tenth embodiment that is similar to the first embodiment except that the guide arm is collapsible for storage. Elements of the tenth embodiment that correspond to the first embodiment are designated by the same reference numeral, incremented by 900. A description of many of these elements is abbreviated or even eliminated in the interest of brevity.

This embodiment includes base member 1000, offset arm 1002, and a guide arm 1004. Guide arm 1004 includes a proximal segment 1070, a middle segment 1072, a distal segment 1074, and a pair of rotatable hinges 1076*a* and 1076*b*. The hinges 1076*a* and 1076*b* are adjustable within a vertical plane and made with enough friction to enable guide arm 1004 to maintain its shape throughout a user's swing.

Hinges 1076*a* and 1076*b* allow this embodiment to be folded into a more compact size when being stored between practice sessions. FIG. 30*b* shows this embodiment folded into the storage position. When ready to begin practicing, the user returns guide arm 1004 to its operating position as shown in FIG. 30*a*.

This embodiment is then used in the same way as the first embodiment. The offset distance of guide arm 1004 is adjusted to give the preselected club-to-leading arm relationship when guide arm 1004 rests against the inside of the leading forearm 135. Throughout the swing the user tries to maintain guide arm 1004 in contact with the inner side of the leading forearm 135.

This embodiment has an advantage of being easily storable when not in use.

Other Embodiments—FIGS. 31-35

FIGS. 31-35 illustrate other possible guide arm shapes.

Figure 31:
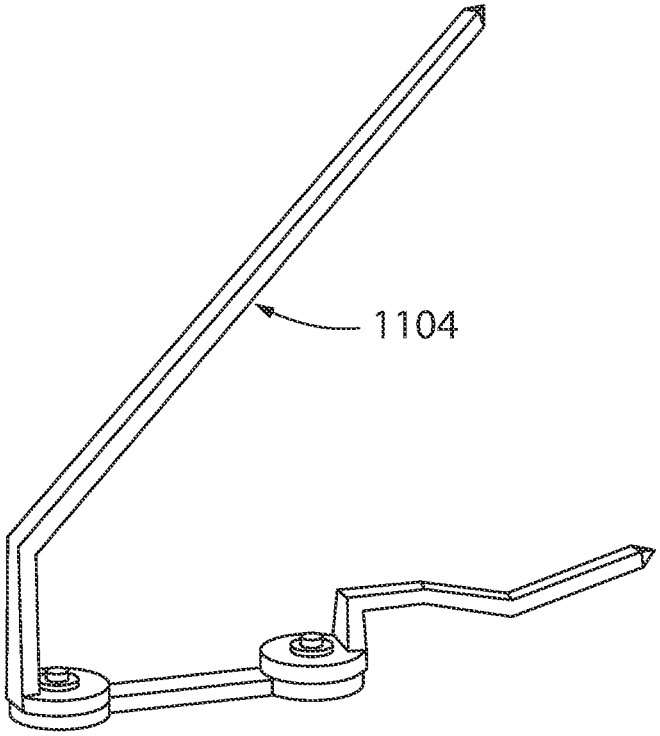
FIG. 31 is a perspective view of a golf swing improvement tool with a straight guide arm set at a forty-five degree angle to the offset arm.

FIG. 31 shows a straight guide arm 1104 set at a forty-five degree angle to the offset arm.

Figure 32:
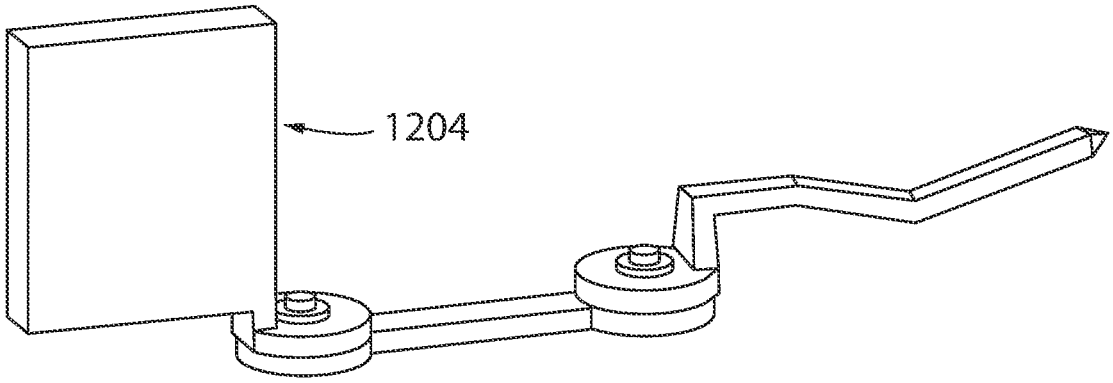
FIG. 32 is a perspective view of a golf swing improvement tool with the guide arm being a rectangular box.

FIG. 32 shows the guide arm 1204 being a rectangular box.

Figure 33:
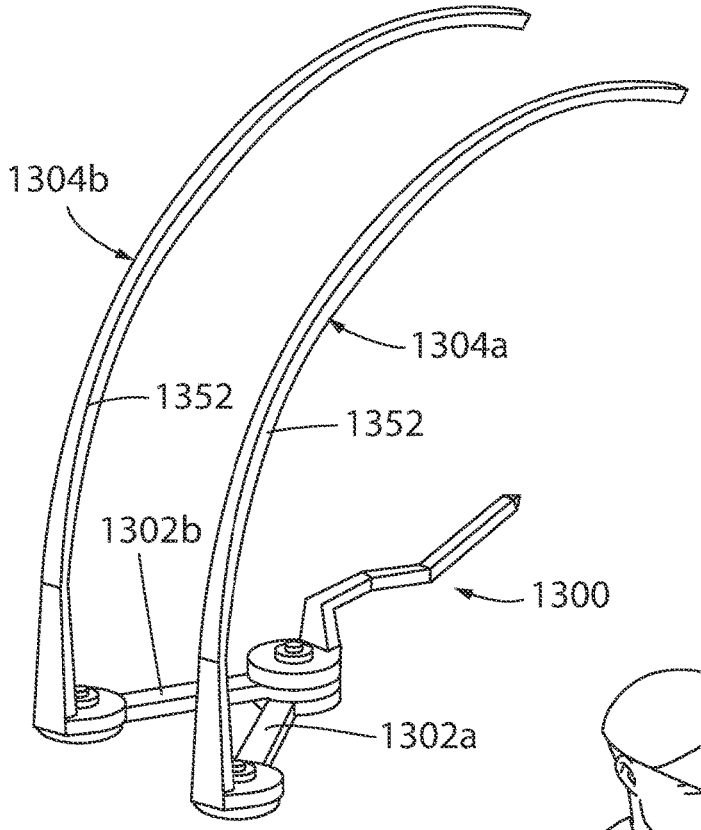
FIG. 33 is a perspective view of a golf swing improvement tool with the guide arm having two curved prongs where each curved prong is on opposite sides of the leading forearm.
Figure 34:
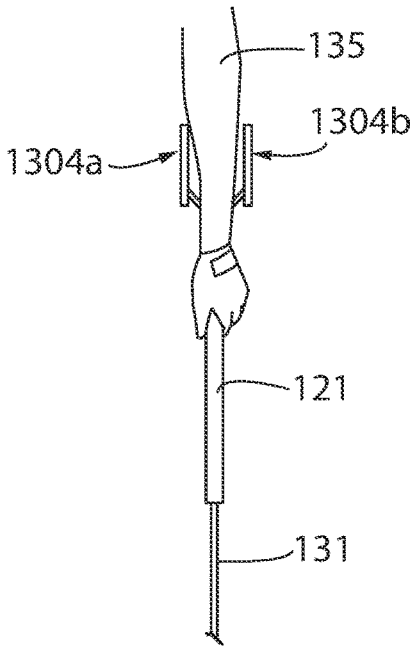
FIG. 34 is a top perspective view of the embodiment shown in FIG. 33 showing the golf improvement tool attached to the golf club.
Figure 35:
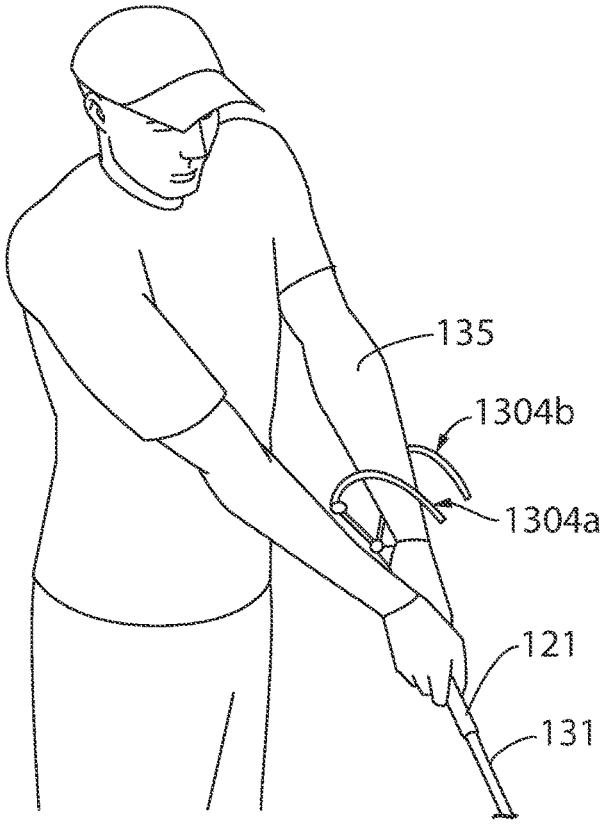
FIG. 35 is an illustration of the embodiment shown in FIG. 33 of the golf club as it is being swung by the user.

FIGS. 33-35 show the guide arm 1304 having two curved prongs 1304*a*, 1304*b* where each curved prong is on opposite sides of the leading forearm 135.

Thus, the golf swing improvement tool can be used by persons of any arm thickness and grip technique to select a variety of precise relationships between the golf club and the leading arm. This adjustability also allows the user to experiment with slight variations in this relationship. One or more embodiments can provide confirmation that the preselected leading arm-to-club relationship is being maintained during a correct swing, and can alert the user if the common error arises of swinging the club unintentionally ahead of the leading arm. In addition, one or more embodiments allow the user to select a customized plane to guide the wrist cock of the leading arm.

While the above description contains many specificities, these should not be construed as limitations on the scope, but rather as an exemplification of several embodiments thereof. Many other variations are possible. For example, the radius of the guide arm can be made larger of smaller, the shape of the guide arm can vary, and different materials for construction are possible such as metal, wood, composites, and alloys. The stop bar assembly shown in FIGS. 21-23 can be included in any other embodiment.

One skilled in the art will recognize that there are other ways to design pivotal connections for the positioning hinges, other ways of securing the golf swing improvement tool to a golf club, and other ways to offset the guide arm. Accordingly, the scope should be determined not by the embodiments illustrated, but by the appended claims and their legal equivalents.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

What I claim is:

1. A golf swing improvement tool comprising:

a coupling attachable to a golf club having a golf club shaft with a golf club head with a transversely extending club head face extending within a club head plane at a lower end of the golf club shaft and a golf club handle at an upper end of the golf club shaft, the golf club shaft extending along a shaft axis;

an offset segment supported by the coupling at a first end and extending away from the shaft axis to a second end wherein the first and second ends are pivotable about first and second axes directed across the shaft axis; and a guide arm attached to the second end of the offset segment and curving within a guide arm plane to an unattached distal end where the guide arm plane is able to be offset from the club head plane.

2. The tool of claim 1 wherein the coupling extends from a top end of the golf club handle.

3. The tool of claim 2 wherein the coupling is adapted to be inserted within the golf club handle and to extend from a top end of the golf club handle.

4. The tool of claim 3 wherein the coupling comprises of angled segments adapted to contact opposed sidewalls of the golf club handle.

5. The tool of claim 2 wherein the coupling is adapted to clasp around the golf club handle.

6. The tool of claim 1 wherein the offset segment provides an adjustable offset of the guide arm away from the shaft axis.

7. The tool of claim 1 wherein the offset segment connects to the guide arm with at least one pivot having an axis parallel to the club head plane.

8. The tool of claim 1 wherein the offset segment provides an adjustable offset by a first pivot pivoting about the first axis, the first axis extending substantially perpendicular to the club shaft axis, and the second pivot pivoting about a second axis, the second axis substantially perpendicular to the club shaft axis, the first pivot connected to the coupling and the second pivot connected to the guide arm.

9. The tool of claim 8 wherein the offset segment further comprises a third pivot pivoting about a third axis substantially perpendicular to the first and second axes.

10. The tool of claim 1 wherein the guide arm plane and the club head plane are adjustable to be offset.

11. The tool of claim 1 wherein the offset segment provides an adjustable offset by a slide bar slideable along an axis perpendicular to the shaft axis.

12. The tool of claim 1 wherein the guide arm comprises a stop bar extending perpendicular to the guide arm plane and supported at the unattached distal end of the guide arm.

13. The tool of claim 1 wherein the guide arm extends toward a top edge of the club head face.

14. The tool of claim 1 wherein the guide arm extends toward a bottom edge of the club head face.

* * * * *